US010415874B1

(12) United States Patent
Beck

(10) Patent No.: US 10,415,874 B1
(45) Date of Patent: Sep. 17, 2019

(54) UNDER CABINET/SHELF STORAGE RACK

(71) Applicant: Ronald Beck, Rockledge, FL (US)

(72) Inventor: Ronald Beck, Rockledge, FL (US)

( * ) Notice: Subject to any disclaimer, the term of this patent is extended or adjusted under 35 U.S.C. 154(b) by 0 days.

(21) Appl. No.: 16/281,634

(22) Filed: Feb. 21, 2019

Related U.S. Application Data

(62) Division of application No. 15/885,002, filed on Jan. 31, 2018.

(51) Int. Cl.

| | |
|---|---|
| ***F25D 25/02*** | (2006.01) |
| ***A47B 96/06*** | (2006.01) |
| ***A47B 96/02*** | (2006.01) |
| ***A47B 73/00*** | (2006.01) |
| ***A47B 43/00*** | (2006.01) |

(52) U.S. Cl.
CPC ..... *F25D 25/024* (2013.01); *A47B 43/003* (2013.01); *A47B 73/008* (2013.01); *A47B 96/024* (2013.01); *A47B 96/025* (2013.01); *A47B 96/062* (2013.01)

(58) Field of Classification Search
CPC ... A47B 96/025; A47B 43/003; A47B 46/005; A47B 43/006; A47B 73/00; A47B 77/10; A47B 88/407; A47B 88/40; A47B 88/49; A47B 88/402; A47B 2210/0059; A47B 88/48; A47B 17/00; A47B 21/0314; A47B 2021/0321; A47B 2021/0328; A47B 2021/0335; A47B 2210/15; A47B 46/00; A47B 88/80; A47B 88/60; A47B 96/024; A47B 96/062; A47B 73/008; A47B 57/06; F25D 25/024; F25D 2325/021; F25D 2331/803; F25D 25/02; F25D 23/067; F25D 25/04; F25D 25/027; F25D 2325/022
USPC ..... 312/408, 323–325, 245–248, 266, 310, 312/322, 204; 211/74, 113, 117, 115, 211/116, 118
See application file for complete search history.

(56) References Cited

U.S. PATENT DOCUMENTS

| | | | | | |
|---|---|---|---|---|---|
| 876,159 | A * | 1/1908 | Erickson | ..... | A47B 46/00 144/285 |
| 1,247,367 | A * | 11/1917 | Burchell | ..... | A47B 17/04 312/204 |

(Continued)

FOREIGN PATENT DOCUMENTS

| | | | | |
|---|---|---|---|---|
| CN | 201277789 | * 7/2009 | ..... | F25D 25/02 |
| CN | 104165493 | * 11/2014 | ..... | F25D 25/02 |

(Continued)

*Primary Examiner* — Hiwot E Tefera
(74) *Attorney, Agent, or Firm* — Brian S. Steinberger; Hilary F. Steinberger; Law Offices of Brian S. Steinberger

(57) ABSTRACT

Rack systems, devices, and methods for attaching and providing foldable storage racks underneath refrigerator shelves or cabinets or other shelves for suspending, storing and separating wine bottles and beverage cans and plates. The storage racks can include a plurality of bail cradles each having ends pivotally attached to brackets. The bail cradles can have concave support surfaces for supporting and separating bottles and cans. The bail cradles can have ribbed upper surfaces for allowing a shelf/tray to slide thereon. The racks can have pivotal vertical legs with a slide out drawer on lower ends of the legs. The racks can be used for storing other items such as computer keyboards and the like, used with desks, tables, and the like.

15 Claims, 35 Drawing Sheets

(56) References Cited

U.S. PATENT DOCUMENTS 2,081,788 A * 5/1937 Bottum ..... F25D 25/02 312/291
2,165,654 A 7/1939 Rosenthal
2,640,599 A * 6/1953 Hess ..... A47B 96/025 108/102
2,744,805 A * 5/1956 McMahan ..... A47B 21/02 312/27
3,857,623 A * 12/1974 Schneller ..... A47B 46/005 312/266
3,923,277 A * 12/1975 Perrault ..... F16L 3/00 211/196
4,254,881 A 3/1981 Hard
D264,406 S 5/1982 Arnott
D273,446 S 4/1984 Rankin et al.
4,460,145 A * 7/1984 Ando ..... A47B 46/00 108/140
4,482,066 A * 11/1984 Dykstra ..... A47B 88/493 211/151
4,485,928 A * 12/1984 Staashelnn ..... A47B 61/04 211/1.3
4,998,631 A 3/1991 Fridjhon
5,294,087 A * 3/1994 Drabczyk ..... A47B 21/007 108/138
5,308,158 A * 5/1994 Vogelgesang ..... A47B 77/10 211/170
5,329,865 A * 7/1994 McWard ..... A47B 46/005 108/93
D376,299 S 12/1996 Audet
D379,889 S 6/1997 McArdle
5,727,750 A 3/1998 Kelly
5,871,107 A * 2/1999 Johnson ..... A47B 46/005 211/104
D406,972 S 3/1999 McCoy
6,308,837 B1 10/2001 Bragg et al.
D504,585 S 5/2005 Rafoth et al.
6,938,866 B2 * 9/2005 Kirchhoff ..... A47B 21/0314 248/274.1
D634,992 S 3/2011 McNamee
8,136,897 B2 * 3/2012 Mascari ..... A47B 46/005 16/342
8,727,457 B2 * 5/2014 Marshall ..... A47J 31/44 312/246
8,851,306 B2 * 10/2014 Spurr ..... A47B 46/005 211/117
9,016,811 B2 * 4/2015 Raunikar ..... A47B 88/40 312/249.7
9,217,602 B2 * 12/2015 Lee ..... F25D 25/02
2002/0084395 A1 * 7/2002 Johnson ..... A47B 46/005 248/276.1
2003/0019975 A1 1/2003 Delfino
2003/0080073 A1 5/2003 Huang et al.
2004/0140744 A1 7/2004 Kalieta et al.
2004/0207305 A1 * 10/2004 Kim ..... A47B 46/005 312/408
2005/0206282 A1 * 9/2005 Walburn ..... A47B 46/005 312/312
2006/0125362 A1 * 6/2006 Kim ..... A47B 46/00 312/408
2006/0266905 A1 * 11/2006 Becke ..... F25D 25/021 248/302
2007/0095768 A1 5/2007 Huo
2009/0058247 A1 * 3/2009 Collins ..... F25D 25/02 312/408
2009/0071921 A1 3/2009 Harwin
2010/0066227 A1 * 3/2010 Ramm ..... A47B 51/00 312/408
2015/0300728 A1 * 10/2015 Kim ..... F25D 25/024 312/408
2016/0143485 A1 5/2016 Rinck et al.
2016/0146532 A1 * 5/2016 Choo ..... F25D 25/024 312/408

FOREIGN PATENT DOCUMENTS

DE 19631374 A1 * 2/1998 ..... A47B 73/008
DE 102010039618 A1 * 2/2012 ..... F25D 25/021
FR 2652248 A1 * 3/1991 ..... A47B 77/04

* cited by examiner

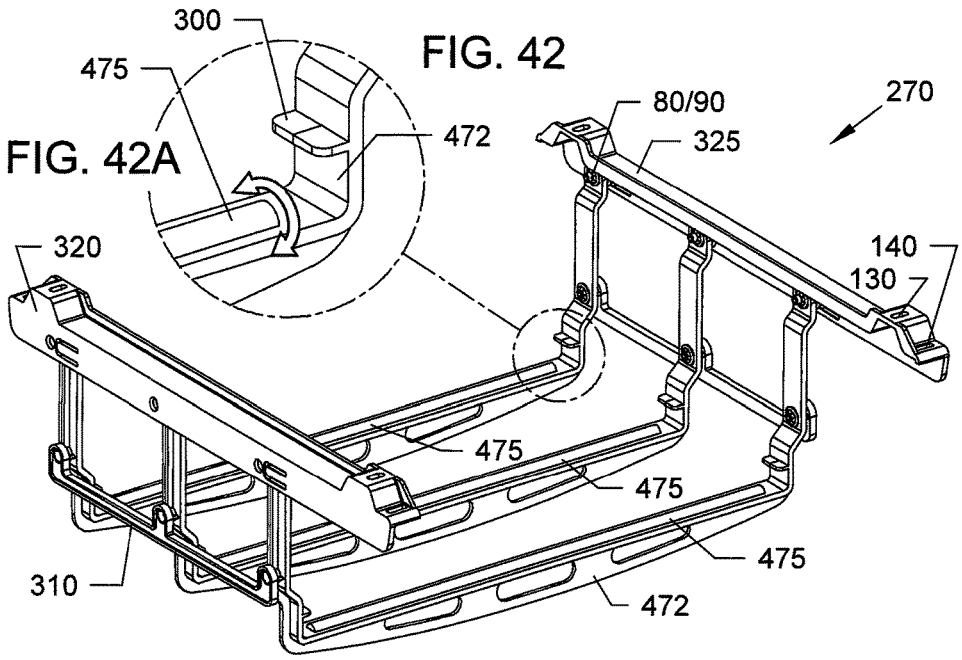
300
475
FIG. 42
FIG. 42A
472
80/90
325
270
320
140
130
475
475
475
310
472
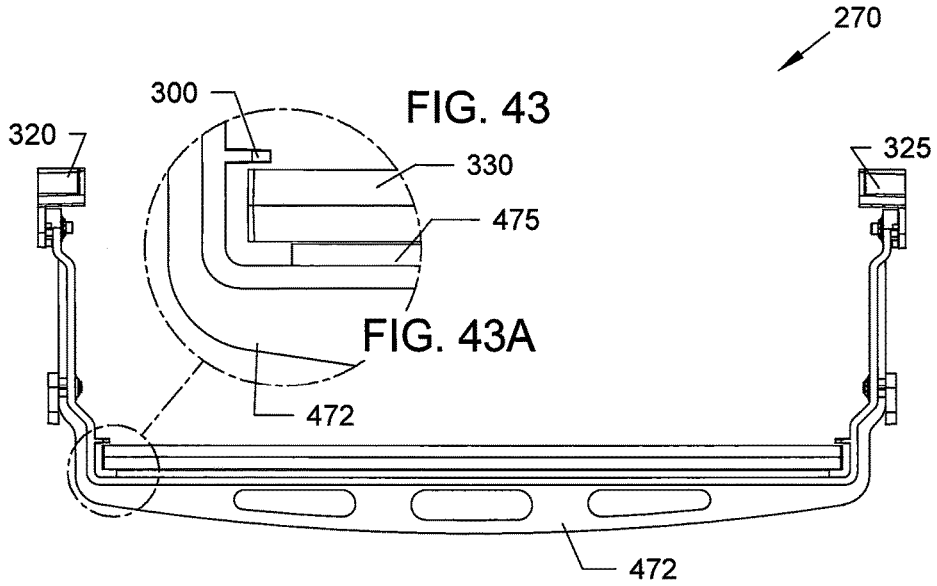
270
300
FIG. 43
320
330
325
475
FIG. 43A
472
472

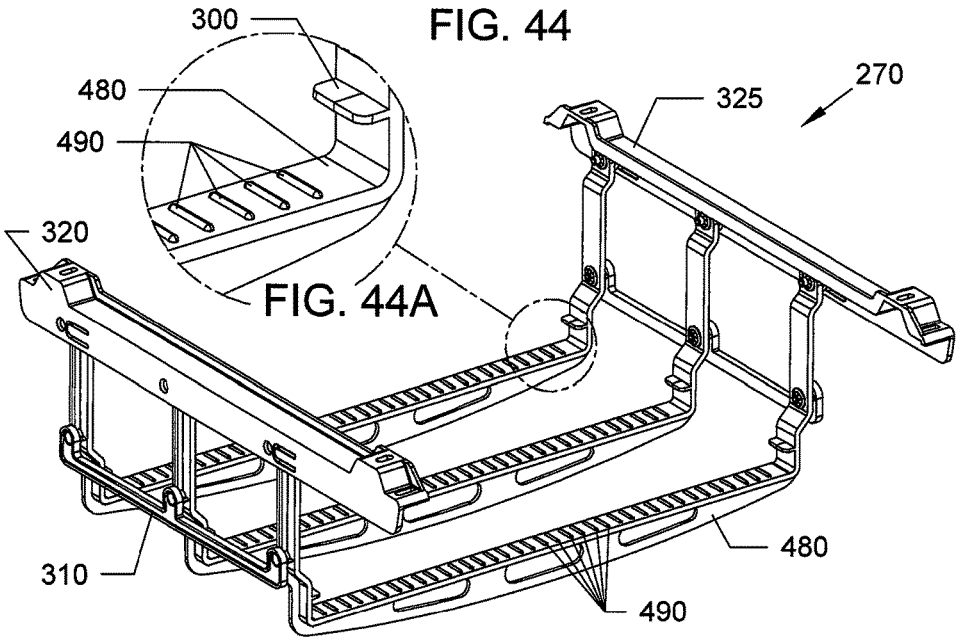
FIG. 44
300
480
490
320
FIG. 44A
325
270
310
480
490
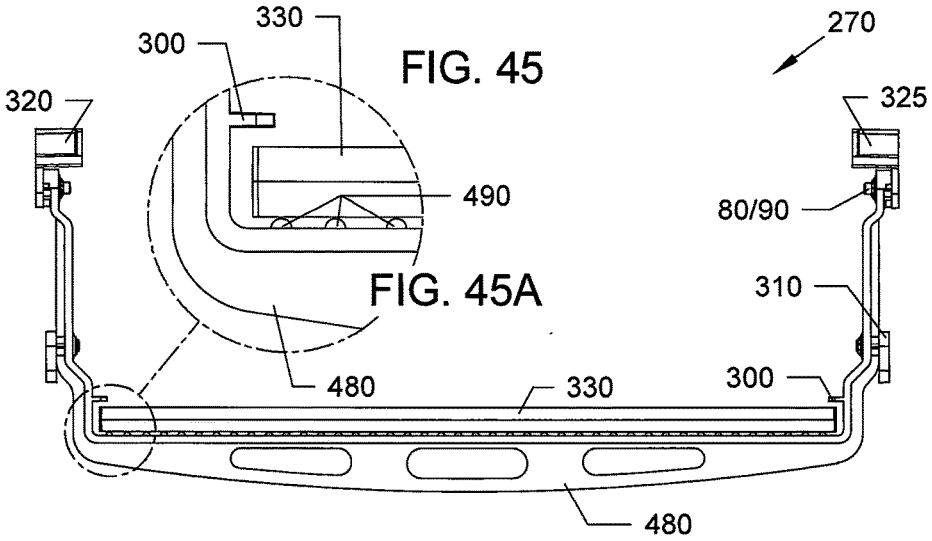
330
300
FIG. 45
270
320
325
490
80/90
FIG. 45A
310
480
330
300
480

UNDER CABINET/SHELF STORAGE RACK

RELATED APPLICATIONS

This application is a Divisional Patent Application of U.S. patent application Ser. No. 15/885,002 filed Jan. 31, 2018, which is incorporated by reference in its' entirety.

FIELD OF INVENTION

This invention relates to storage racks, and in particular to rack systems, devices, and methods for attaching and providing foldable storage racks underneath refrigerator shelves or cabinets or other horizontal surfaces or horizontal shelves for suspending, storing and separating wine bottles, beverage cans, and small goods, such as plates, kitchen tools, such as bottle openers, cork screws, cap openers, and other items such as keyboards and the like.

BACKGROUND AND PRIOR ART

Bottles of wine are often stored in upright positions inside of cabinets which makes the bottles hard to retrieve as well as take up large vertical amounts of shelf space. In addition, storing bottles in standing conditions is not always secure since the bottles can end up leaning against each other, and can easily become broken over time.

Various multiple level conventional racks have been proposed over the years for wine storage. See for example, U.S. Pat. No. 4,998,631 to Fridjhon and U.S. Published Patent Application 2003/0080073 to Huang et al. However, these devices require large amounts or space to be used on countertop space or under shelves in kitchens, and the like. However, kitchen space can be limited, and these conventional racks for storing wine bottles are generally bulky.

Hanging racks have been proposed over the years for wine type bottles. See for example, U.S. Design Patents: Des. 273,446 to Rankin et al. and Des. 376,299 to Audet and U.S. Published Patent Application 2009/0071921 to Harwin. However, these devices are bulky and extend a substantial distance below a mounting surface, such as a shelf, or ceiling, taking up undesirable amounts of space especially when not in use.

Additionally, none of the above prior art allows for the rack to be folded upward when not being used. None of the above prior art can be used underneath shelves inside of refrigerators, and coolers. None of the above prior art can be mounted underneath cabinets and/or shelves to make use of known space that is generally not used.

Thus, the need exists for solutions to the above problems with the prior art.

SUMMARY OF THE INVENTION

A primary objective of the present invention is to provide rack systems, devices, and methods for attaching and providing foldable storage racks underneath refrigerator shelves for suspending, storing and separating wine bottles, beverage cans, and/or small goods, such as plates, kitchen tools, such as bottle openers, cork screws, cap openers.

A secondary objective of the present invention is to provide rack systems, devices, and methods for attaching and providing foldable storage racks underneath cabinets for suspending, storing and separating wine bottles, beverage cans, and/or small goods, such as plates, kitchen tools, such as bottle openers, cork screws, cap openers.

A third objective of the present invention is to provide rack systems, devices, and methods for attaching and providing foldable storage racks underneath shelves for suspending, storing and separating wine bottles, beverage cans, and/or small goods, such as plates, kitchen tools, such as bottle openers, cork screws, cap openers.

A fourth objective of the present invention is to provide rack systems, devices, and methods for attaching and providing foldable storage racks underneath shelves, and tables for suspending, storing keyboards for computers and the like.

A fifth objective of the present invention is to provide rack systems, devices, and methods for attaching and providing foldable storage racks underneath shelves, and tables for suspending, storing pull out drawers and the like.

A foldable rack system can include a first elongated bracket having a front end and a rear end a second elongated bracket having a front end and a rear end, the first elongated bracket being spaced from and in parallel to the second elongated bracket, a first cradle member having a left end and a right end, the left end of the first cradle member being pivotally attached to the first elongated bracket adjacent to the front end of the first elongated bracket, and the right end of the first cradle member being pivotally attached to second elongated bracket adjacent to the front end of the second elongated bracket, a second cradle member having a left end and a right end, the left end of the second cradle member being pivotally attached to the first elongated bracket adjacent to the rear end of the first elongated bracket and the right end of the second cradle member pivotally attached to the second elongated bracket adjacent to the rear end of the second elongated bracket, the second cradle member being spaced apart and parallel to the first cradle member, wherein the first cradle member and the second cradle member are pivotally moveable from a folded down position with the first and the second cradle members extending downward from the first and the second elongated brackets, to a folded up position with the first and the second cradle members both folded adjacent to the first and the second elongated brackets.

The foldable rack system can include a pair of straps for attaching each of the first and the second elongated brackets under a shelf.

The foldable rack system can include a left link arm having a rear end and a front end, the rear end being pivotally attached to the left end of the second cradle member, the front end of the left link arm being pivotally attached to left end of the first cradle member, and a right link arm having a rear end and a front end, the rear end of the right link arm being pivotally attached to the right end of the second cradle member, the front end of the right link arm being pivotally attached to the right end of the first cradle member.

The foldable rack system can include bendable tabs and detents for locking the first and the second cradle members in the folded up position and the folded down position.

Each of the first cradle member and the second cradle member can include a plurality of side by side concave curved portions along a top surface, the concave curved portions adapted to support bottles laid on their sides.

The foldable rack system can include screw fasteners for attaching each of the first and the second elongated brackets to an under surface of a shelf.

The foldable rack system can include an accessory shelf for sliding on the first and the second cradle members when the first and the second cradle members are in the folded down position.

The horizontal shelf can include a plurality of raised ribs spaced apart from one another on at least one side of the accessory shelf.

The foldable rack system can include anti-tip tabs on inner sides of the first and the second cradle members for keeping the accessory shelf from tilting.

The foldable rack system can include rotatable balls on upper surfaces of the first and the second cradle members for allowing the accessory shelf to easily slide thereon.

The foldable rack system can include rollers on upper surfaces of the first and the second cradle members for allowing the accessory shelf to easily slide thereon.

The foldable rack system can include a third cradle member having a left end and a right end, the left end of the third cradle member being pivotally attached to the first elongated bracket between the front end and the ear end of the first elongated bracket, and the right end of the third cradle member pivotally attached to the second elongated bracket between the front end and the rear end of the second elongated bracket, the third cradle member being spaced apart and parallel to the first cradle member and the second cradle member.

The foldable rack system can include a left link arm having a rear end and a front end, the rear end being pivotally attached to the left end of the second cradle member, the front end of the left link arm being pivotally attached to the left end of the first cradle member, and a middle portion of the left link arm being pivotally attached to the left end of the third cradle member, and a right link arm having a rear end and a front end, the rear end of the right link arm being pivotally attached to the right end of the second cradle member, the front end of the right link arm being pivotally attached to the right end of the first cradle member, and a middle portion of the right link arm being pivotally attached to the right end of the third cradle member.

Another embodiment of the foldable rack system can include a left elongated bracket having a front end and a rear end, a right elongated bracket having a front end and a rear end, the left elongated bracket being spaced from and in parallel to the right elongated bracket, a plurality of left vertical leg members having upper ends spaced apart from one another and pivotally attached to the left elongated member and lower ends, a plurality of right vertical leg members having upper ends spaced apart from one another and pivotally attached to the right elongated member and lower ends, and a shelf having a left side, a right side, a front side and a rear side, the lower ends of the plurality of left vertical leg members are pivotally attached to the left side of the shelf, and the lower ends of the plurality of the right vertical leg members are pivotally attached to the right side of the shelf, wherein the shelf has a folded down position with the plurality of the left vertical leg members and the plurality of the right vertical leg members are in a down position, and a folded up position with the plurality of the left vertical leg members and the plurality of the right vertical leg members are in a folded position.

The foldable rack system can include a left inner race pivotally attached to the lower ends of the plurality of the left vertical leg members, a left outer race slidingly attached to the left inner race, the left outer race being attached to the left side of the shelf, a right inner race pivotally attached to lower ends of the plurality of the right vertical leg members and a right outer race slidingly attached to the right inner race, the right outer race being attached to the right side of the shelf.

The foldable rack system can include an accessory tray for being placed on the shelf.

The foldable rack system can include raised ribs on a top surface for separating beverage containers placed thereon.

The shelf can include a slide out drawer.

Further objects and advantages of this invention will be apparent from the following detailed description of the presently preferred embodiments which are illustrated schematically in the accompanying drawings.

BRIEF DESCRIPTION OF THE FIGURES

The drawing figures depict one or more implementations in accord with the present concepts, by way of example only, not by way of limitations. In the figures, like reference numerals refer to the same or similar elements.

First Embodiment

Second Embodiment

Figure 23:
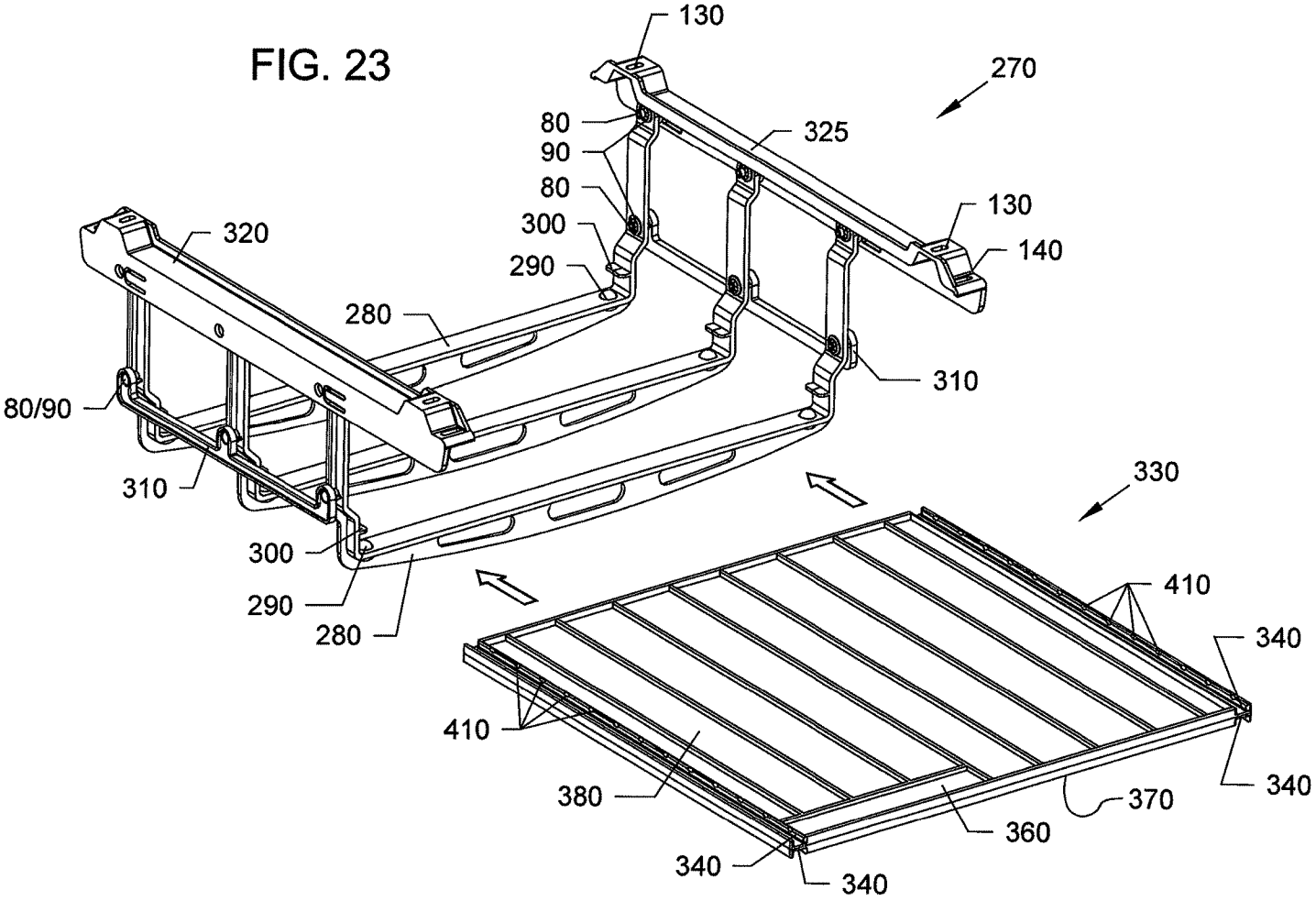

FIG. 23 is a top perspective view of a second embodiment of a fold-down storage assembly with a sliding shelf ready to accept packaged 12 or 24 packs of canned beverage or an optional accessory shelf.

Figure 24:
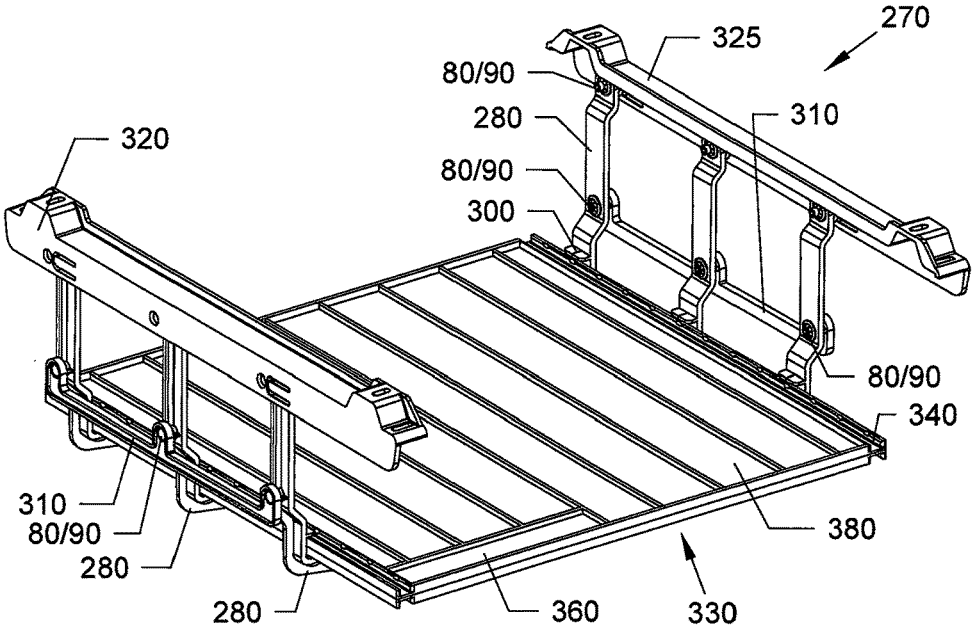

FIG. 24 is another view of FIG. 23 with the accessory shelf resting on the bail cradles.

Figure 25:
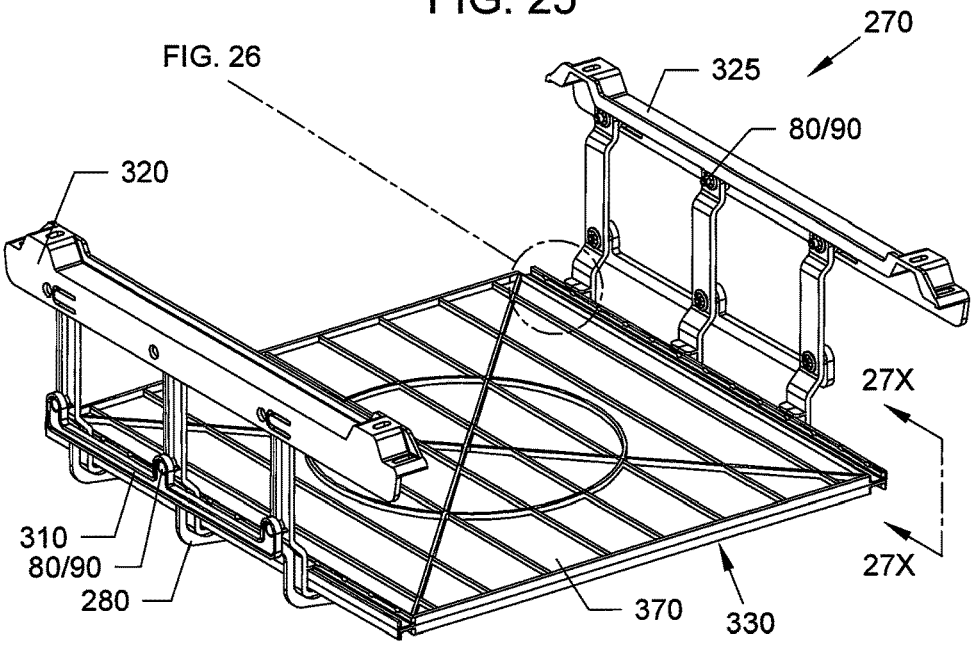

FIG. 25 is another view of FIG. 24 with the accessory shelf turned upside down showing the bottom side of the accessory shelf.

Figure 26:
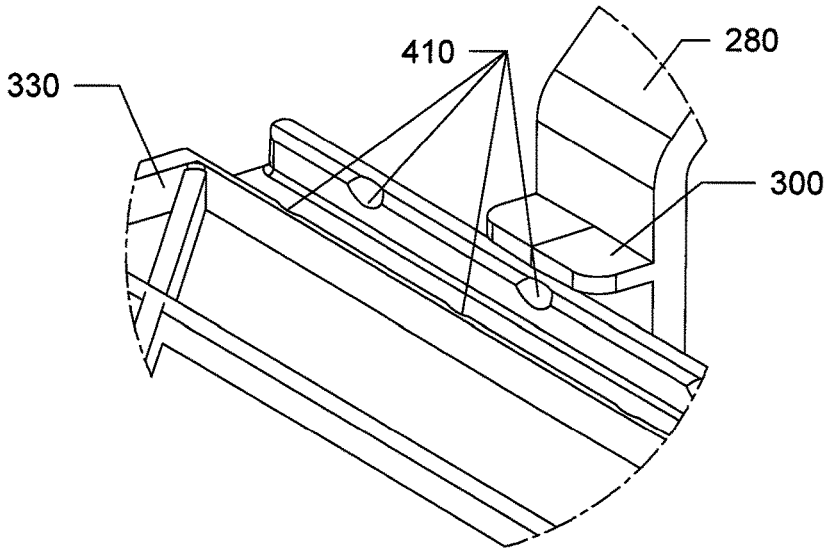

FIG. 26 is an enlarged view of a section of FIG. 25 showing track detail on the accessory shelf with multiple detents along both top edges of the track.

Figure 27:
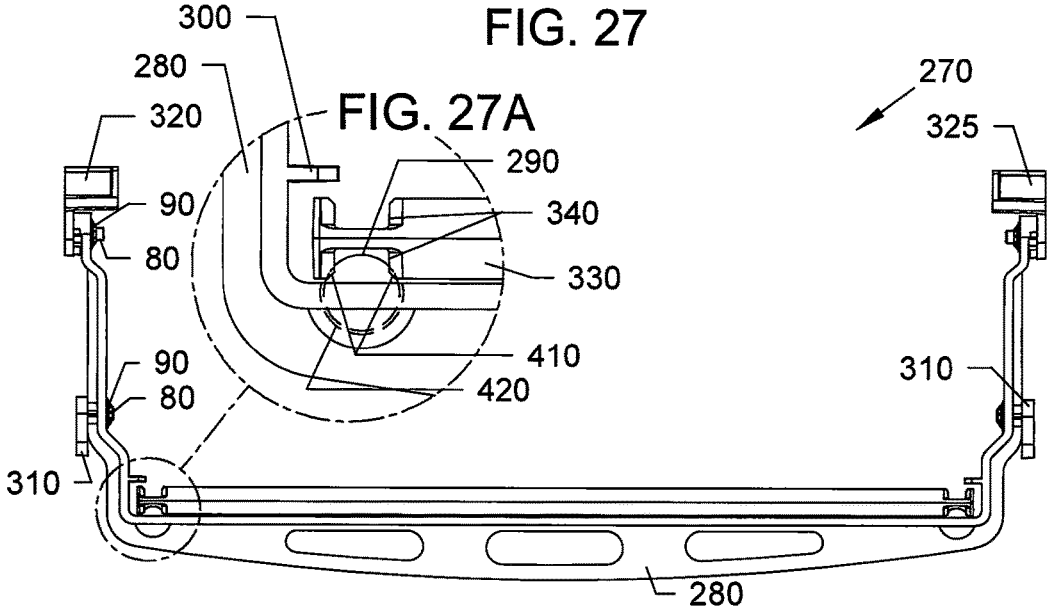

FIG. 27 is a front view of storage assembly of FIG. 23.

FIG. 27A is an enlarged view showing a ball track detail portion of FIG. 27.

Figure 28:
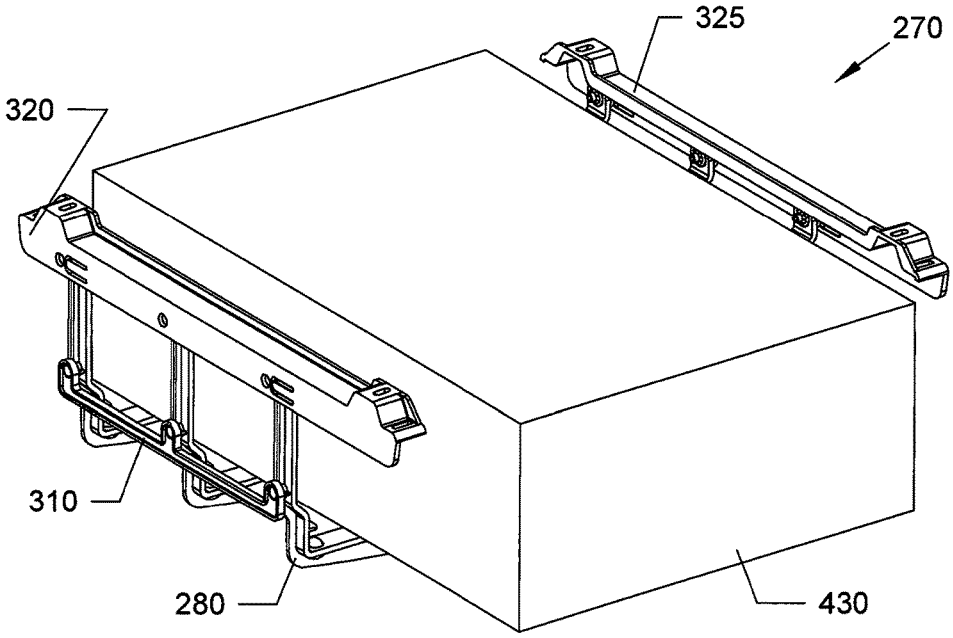

FIG. 28 is another view of the assembly of FIG. 27 showing a 24 pack of beverage cans stored.

Figure 29:
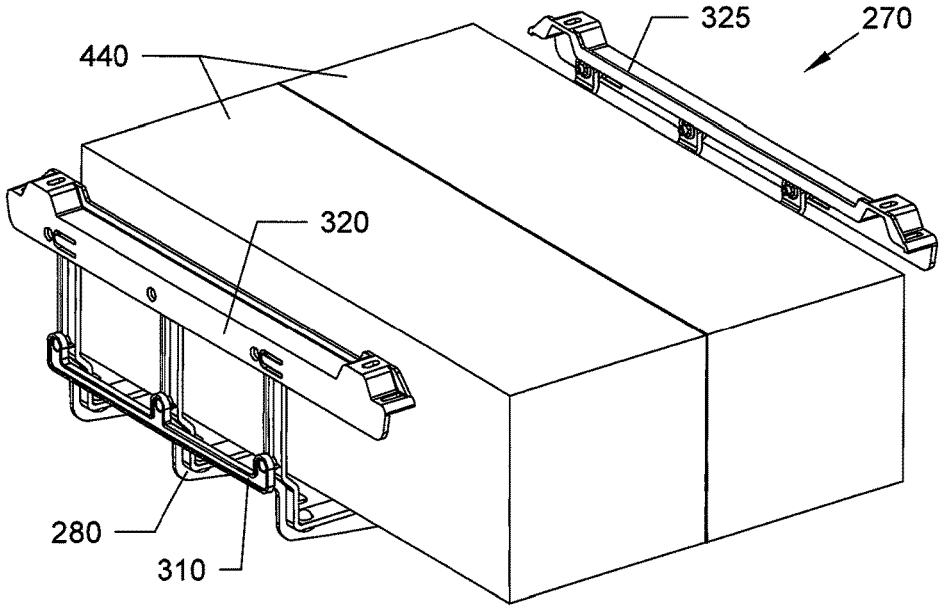

FIG. 29 is another view of the assembly of FIG. 27 showing two 12 packs of beverage cans stored.

Figure 30:
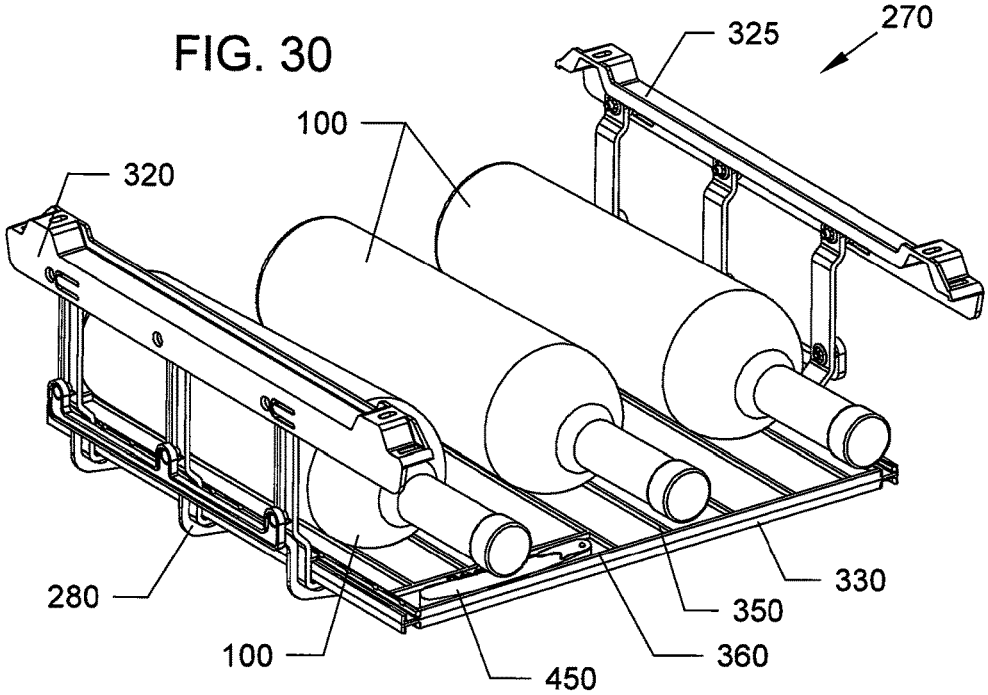

FIG. 30 is another view of FIG. 23 showing wine bottles being stored. The ribs on the top surface of the accessory shelf are designed to keep the bottles in place.

Figure 31:
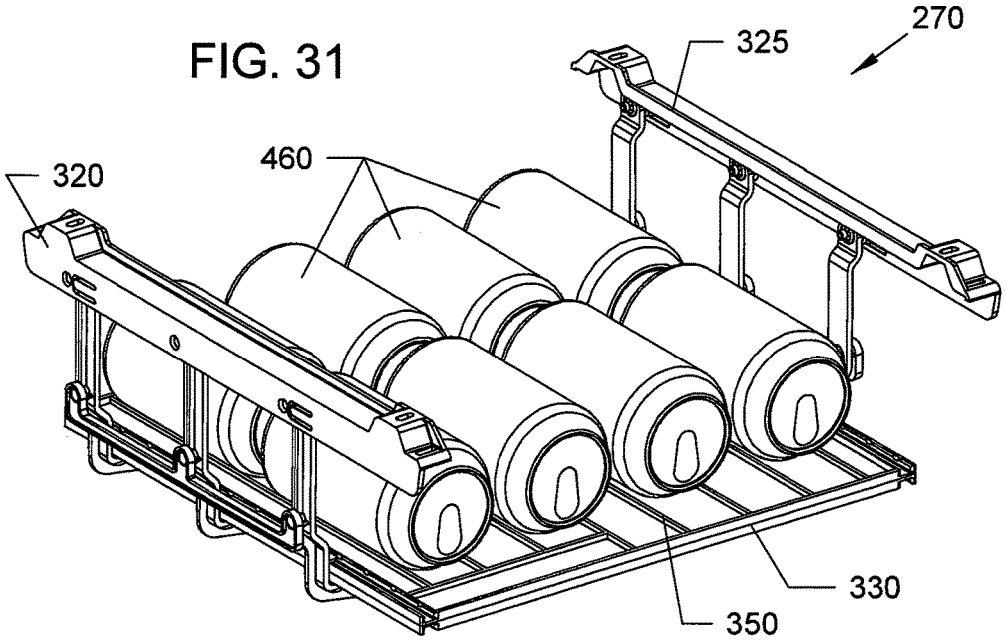

FIG. 31 is another view of FIG. 23 showing 12 beverage cans being stored.

Figure 32:
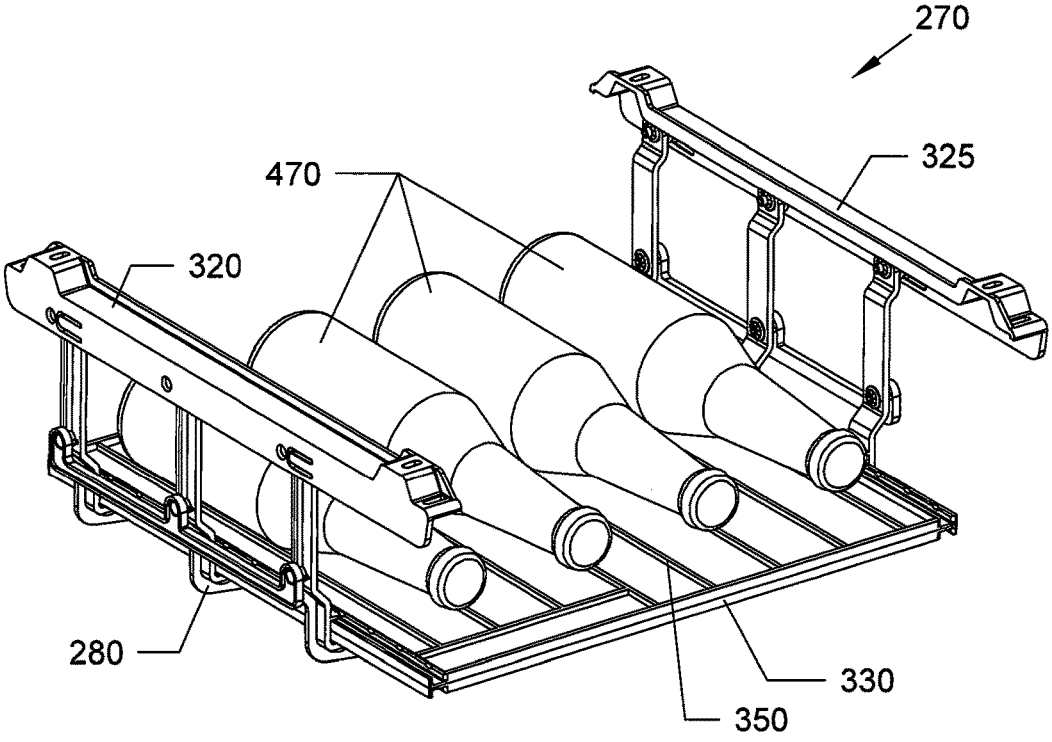

FIG. 32 is another view of FIG. 23 showing beer bottles being stored.

Figure 33:
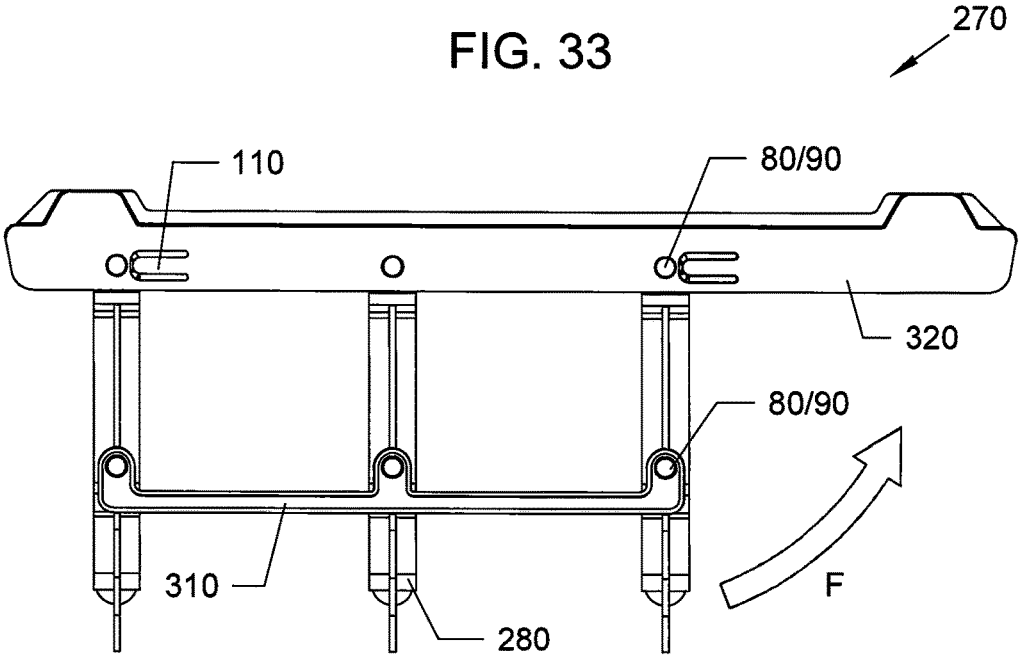

FIG. 33 is a side view of the assembly of FIG. 23 with the bail cradles folded down.

Figure 34:
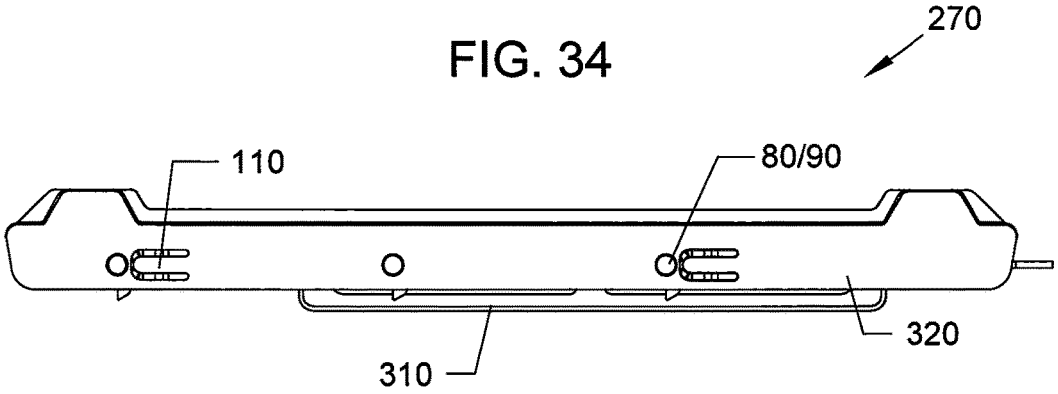

FIG. 34 is another side view of the assembly of FIGS. 23 and 33 with the cradle bails folded up.

Figure 35:
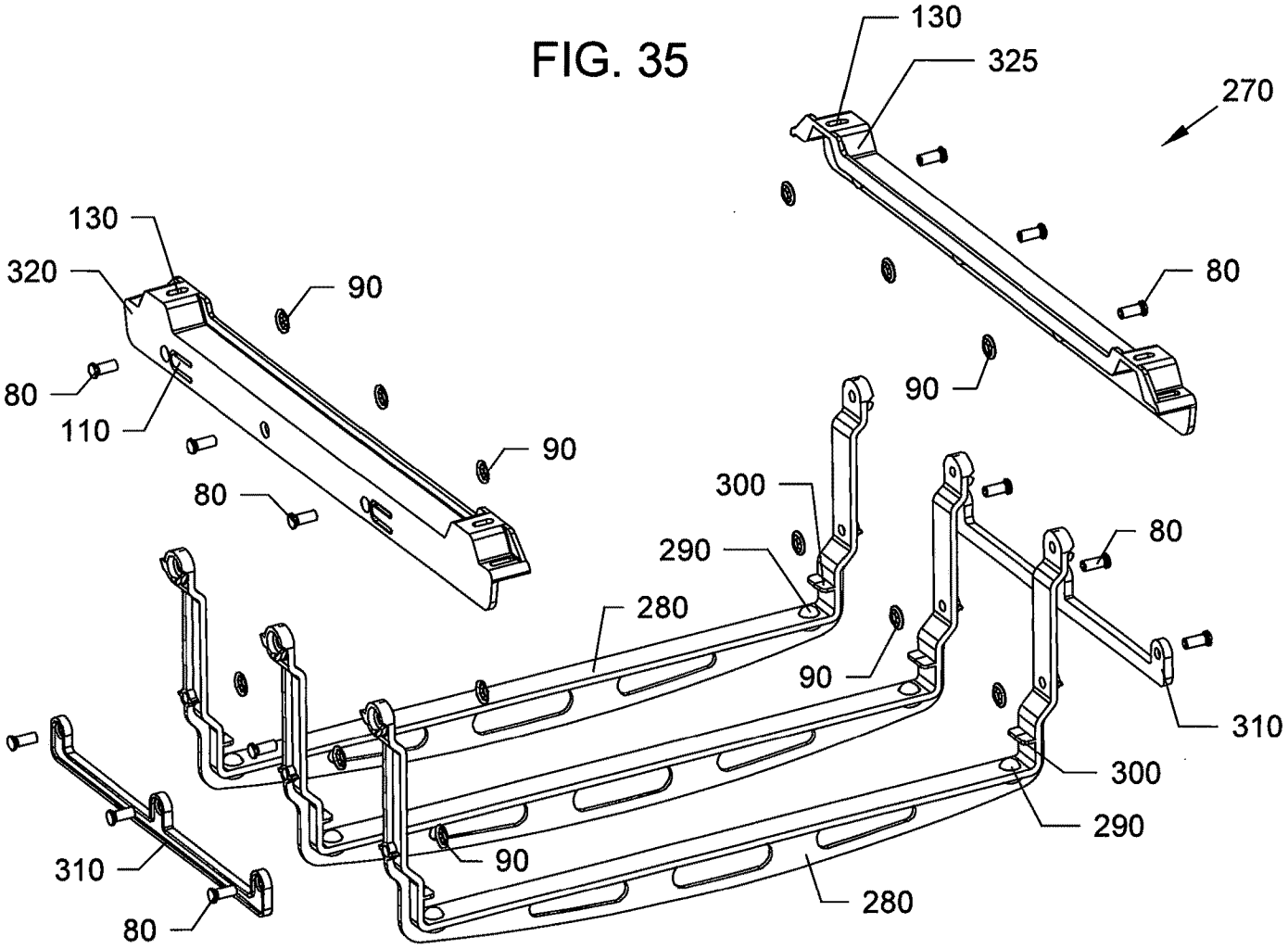

FIG. 35 is an exploded view of the assembly of FIG. 23.

Figure 36:
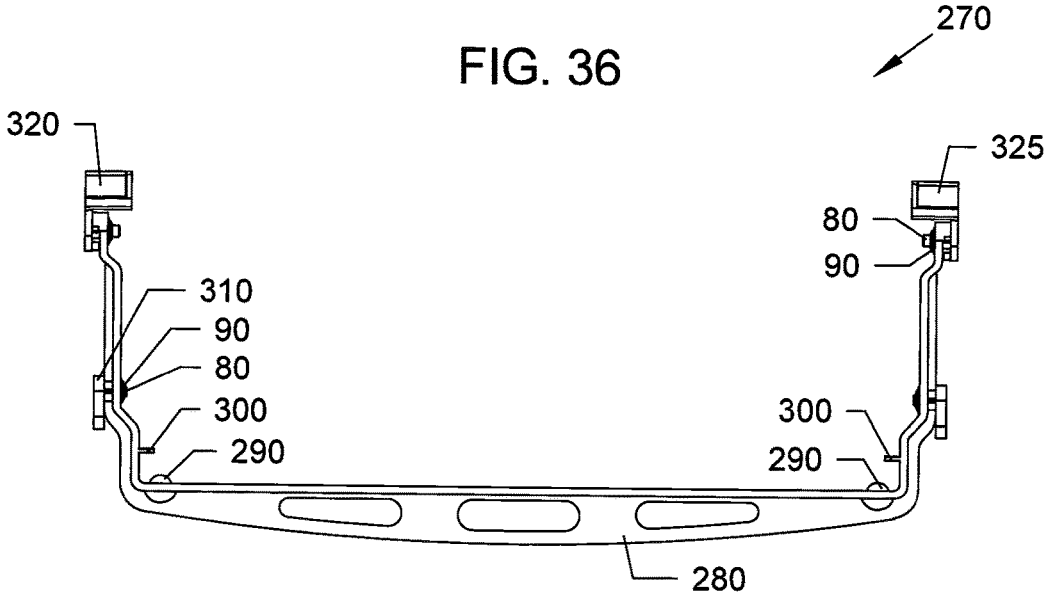

FIG. 36 is a front view of the assembly of FIG. 23.

Figure 37:
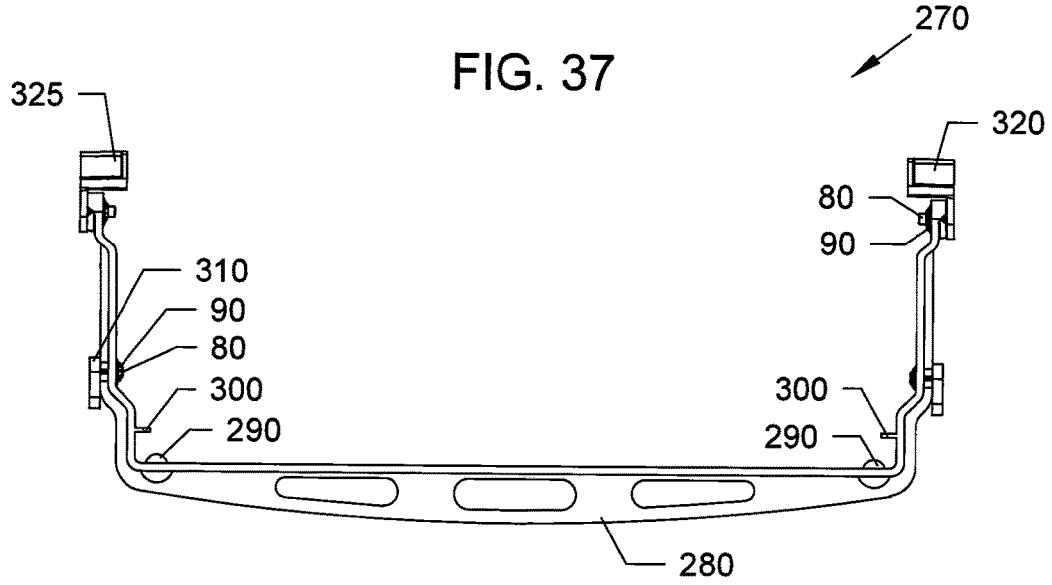

FIG. 37 is a rear view of the assembly of FIG. 23.

Figure 38:
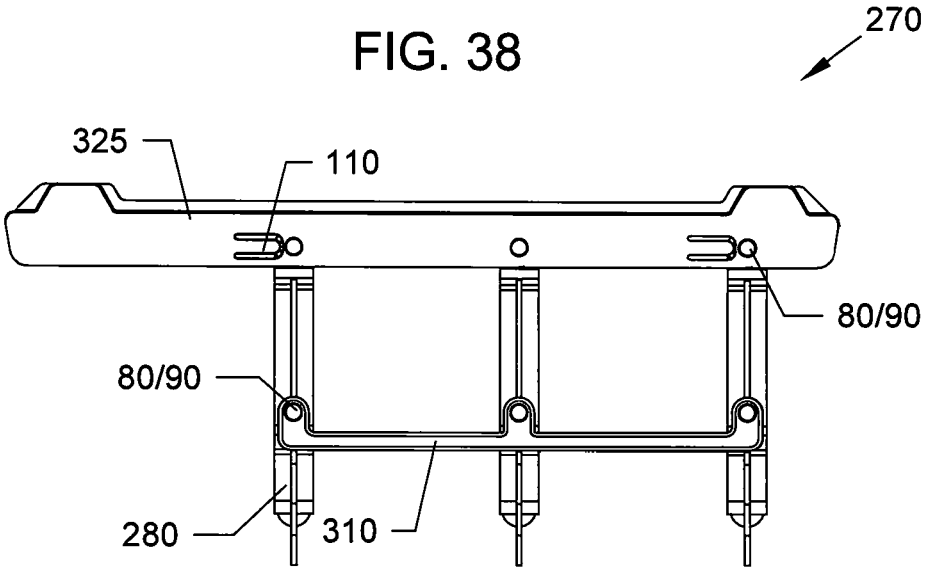

FIG. 38 is a right side view of the assembly of FIG. 23.

Figure 39:
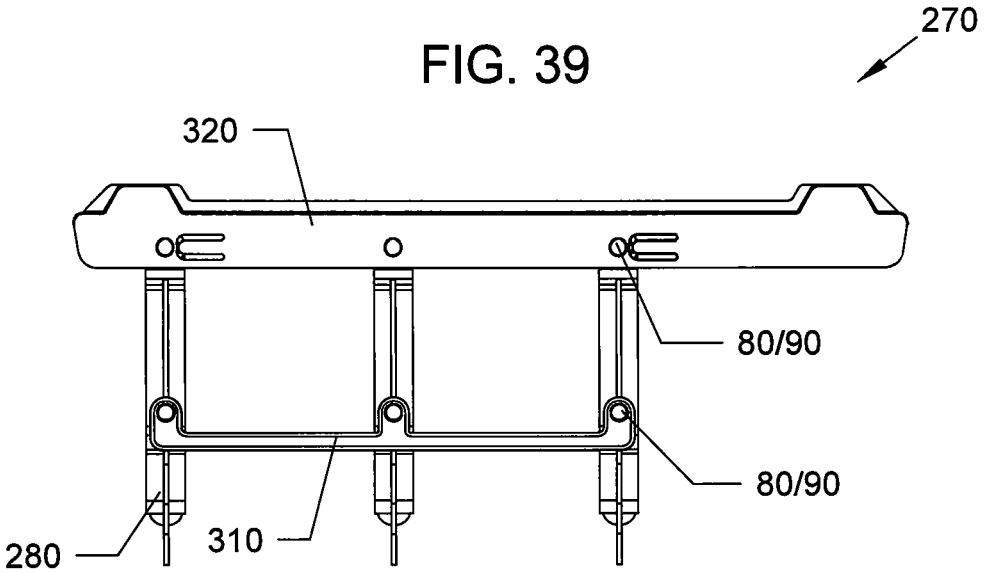

FIG. 39 is a left side view of the assembly of FIG. 23.

Figure 40:
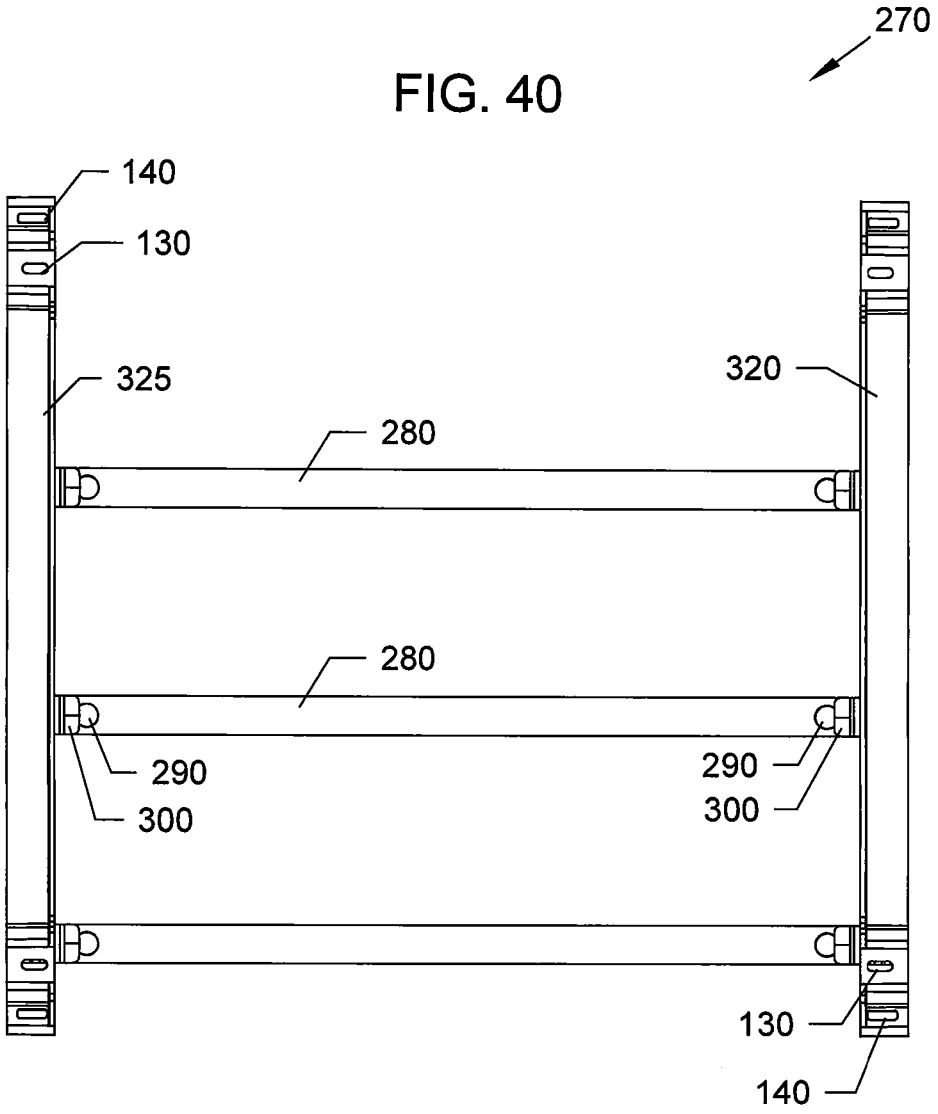

FIG. 40 is a top view of the assembly of FIG. 23.

Figure 41:
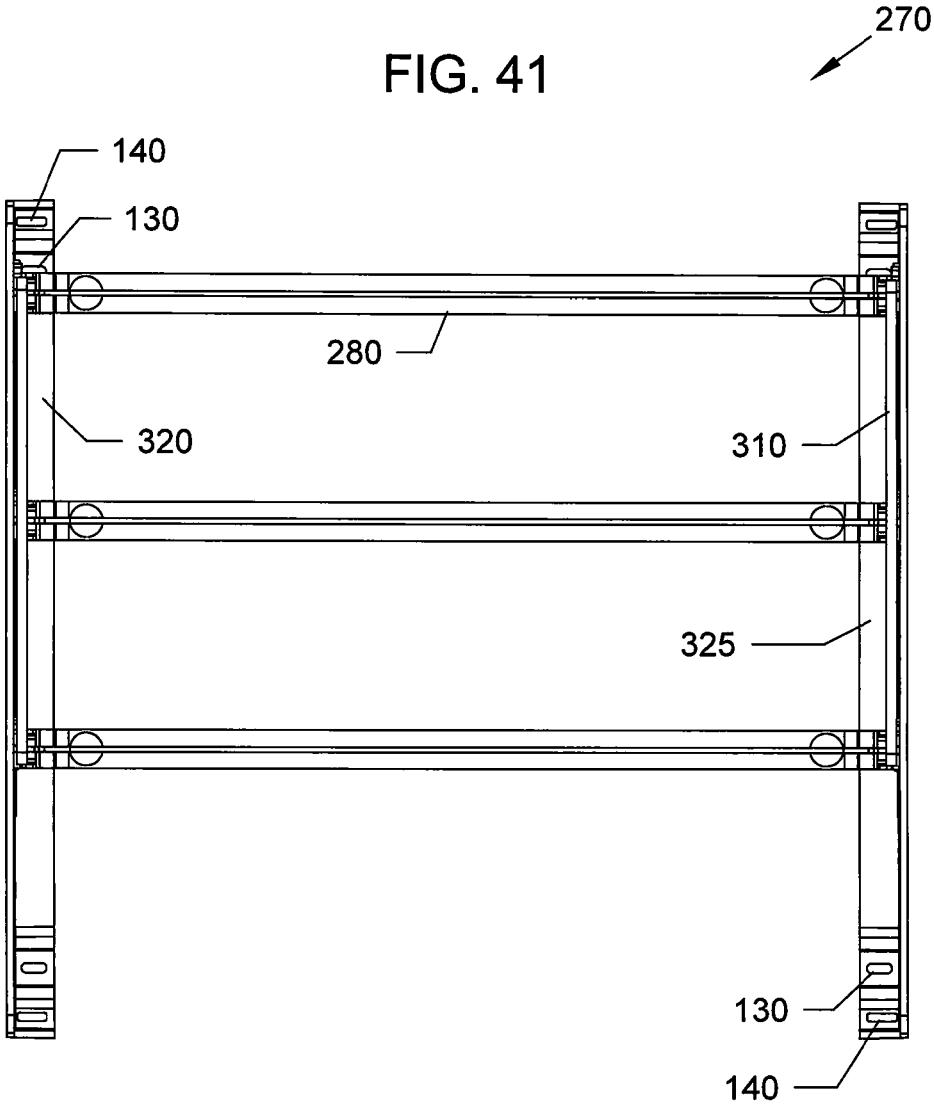

FIG. 41 is a bottom view of the assembly of FIG. 23.

FIG. 42 is another view of FIG. 23 showing alternative rollers replacing the rolling balls on the bottom member of the bails.

FIG. 42A is an enlarged view of a corner the rollers of FIG. 42.

FIG. 43 is another front view of the assembly of FIG. 42 with accessory shelf.

FIG. 43A is an enlarged view of a front corner section of FIG. 43.

FIG. 44 is another view of the assembly of FIG. 23 with raised ribs on the cradle bails.

FIG. 44A is an enlarged view of a raised ribs portion of FIG. 44.

FIG. 45 is a front view of the assembly of FIG. 44 with accessory shelf.

FIG. 45A is an enlarged view of a corner section of FIG. 45.

Third Embodiment

Figure 46:
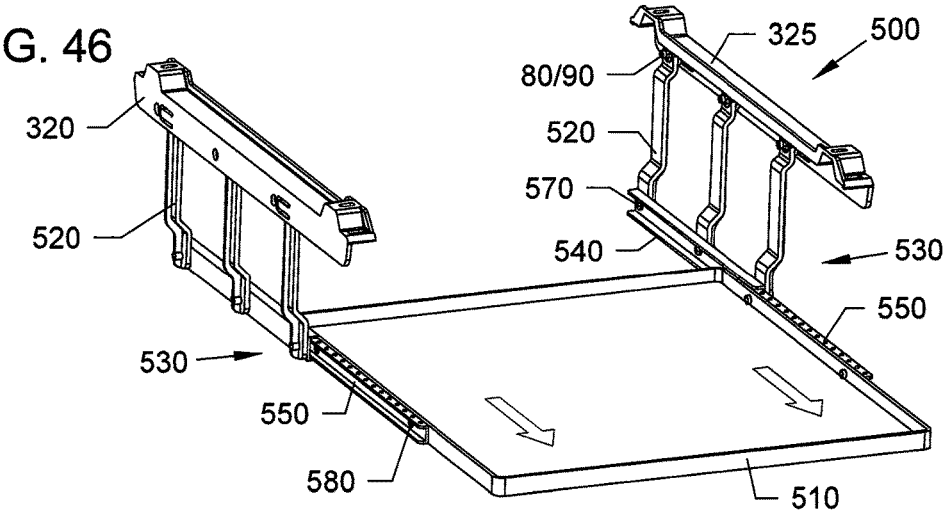

FIG. 46 is a top perspective view of a third embodiment of a fold-down storage assembly with slide out tray.

Figure 47:
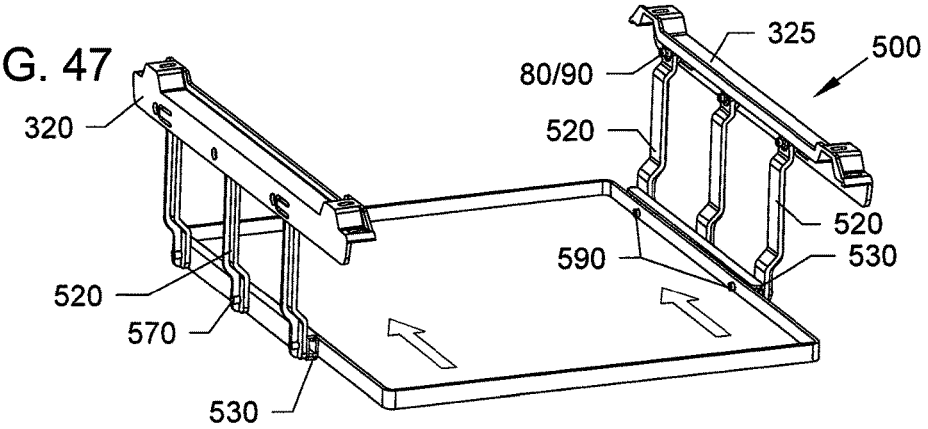

FIG. 47 is another view of the assembly of FIG. 46 with the tray shown down and fully retracted.

Figure 48:
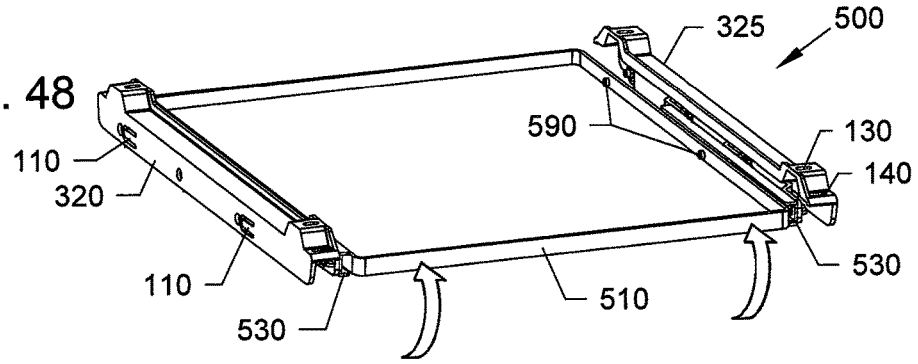

FIG. 48 is a view of the assembly of FIG. 47 with the tray folded up.

Figure 49:
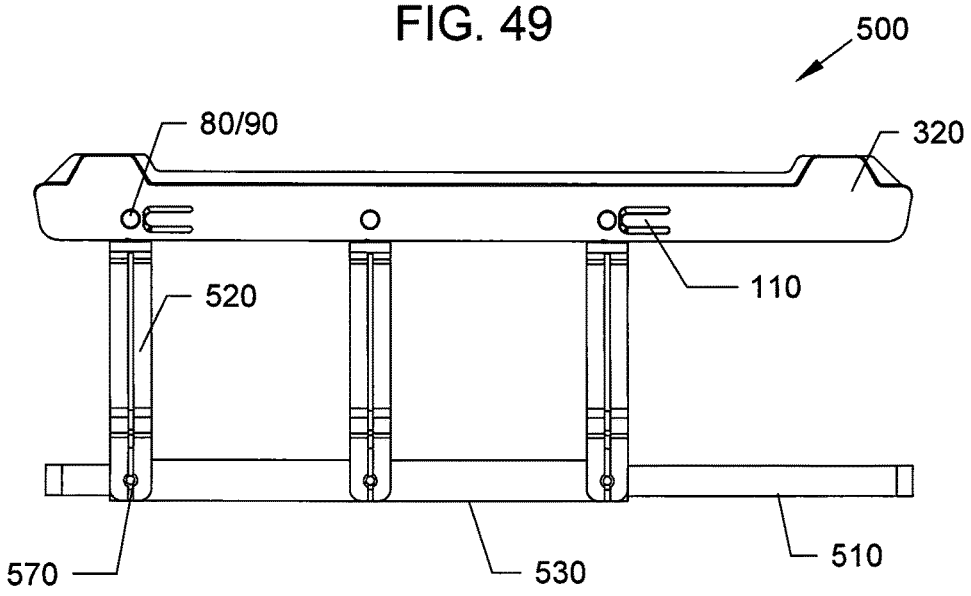

FIG. 49 is a side view of the assembly of FIG. 47.

Figure 50:
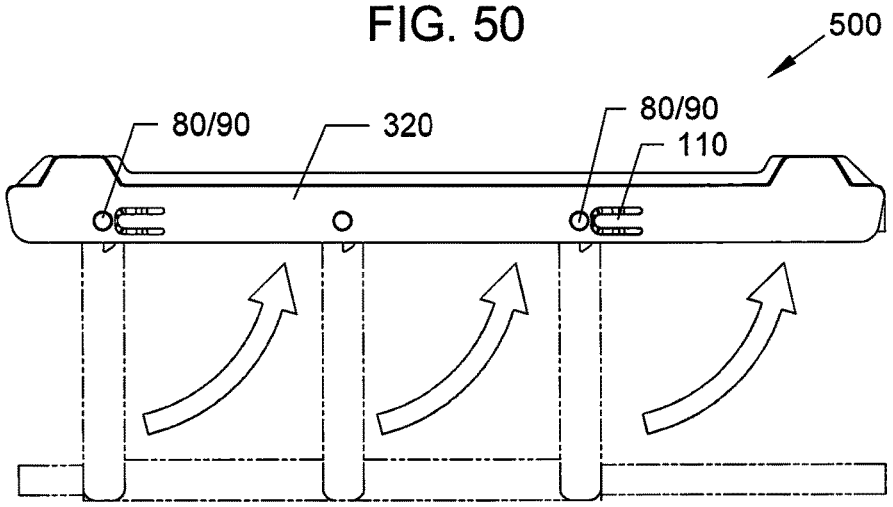

FIG. 50 is another side view of the assembly of FIG. 48 with the tray folded up.

Figure 51:
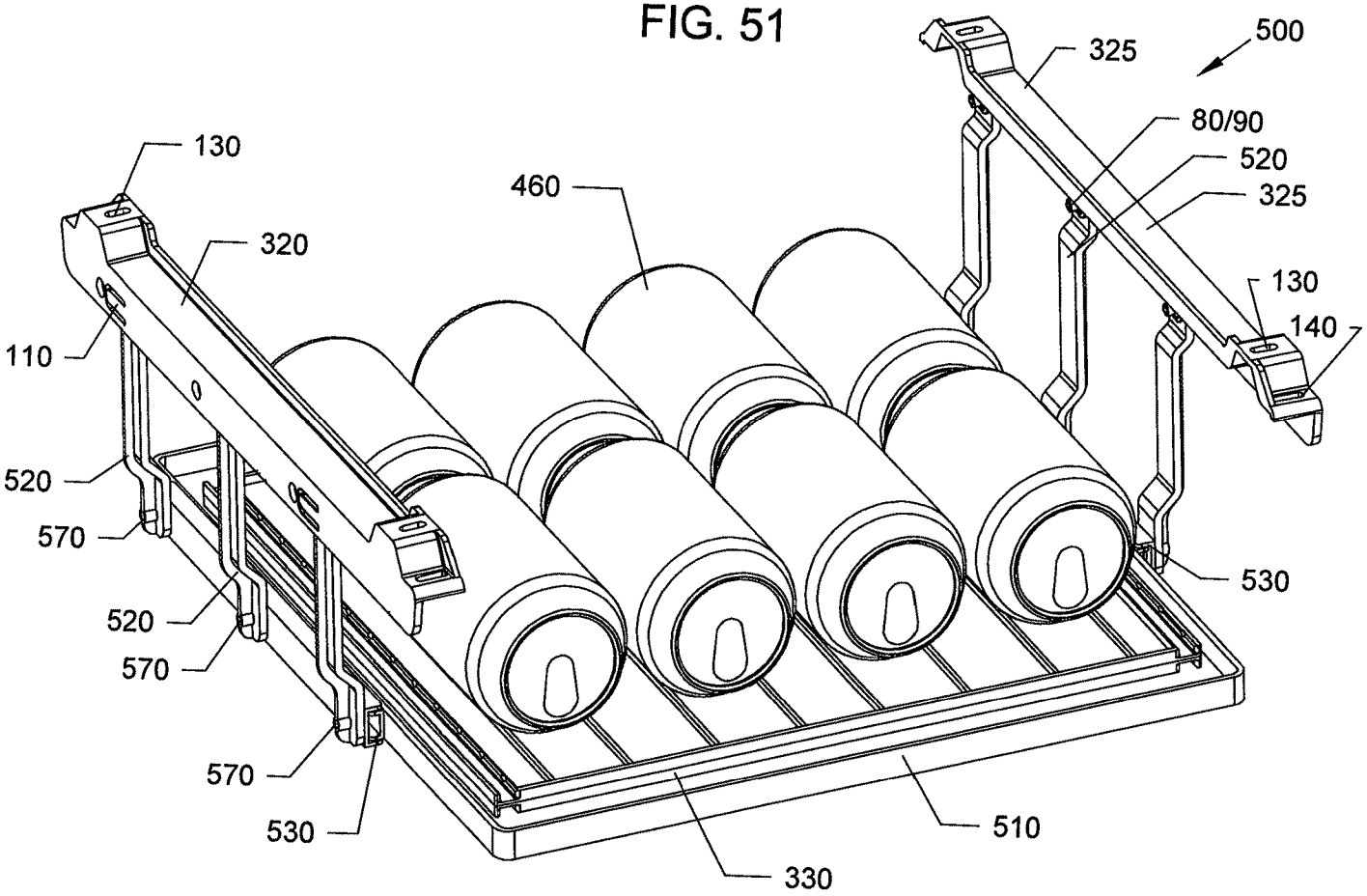

FIG. 51 is a top perspective view of the assembly of FIG. 47 with the accessory shelf shown on the tray and beverage cans being stored.

Figure 52:
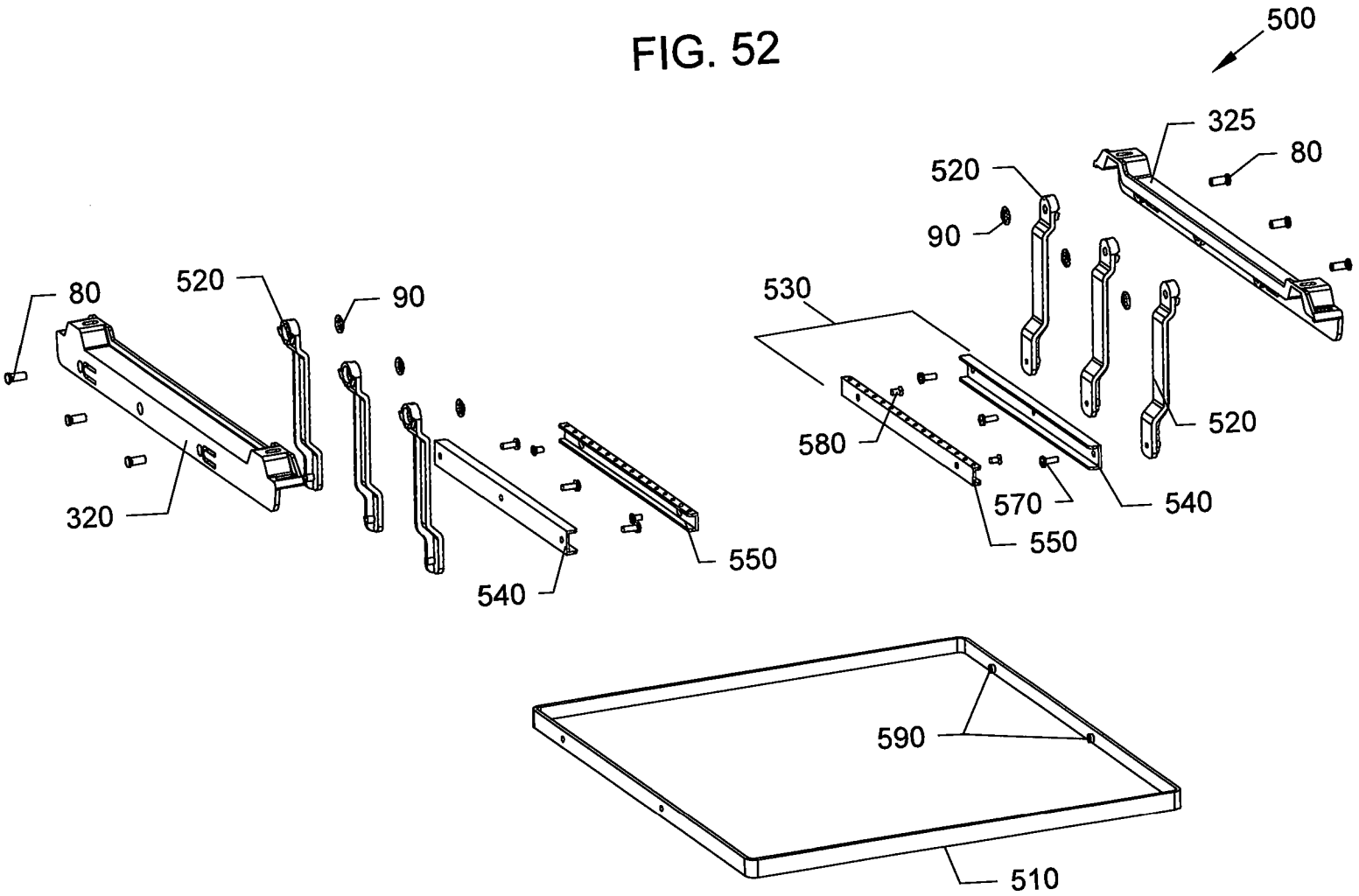

FIG. 52 is an exploded view of the assembly of FIG. 46.

Figure 53:
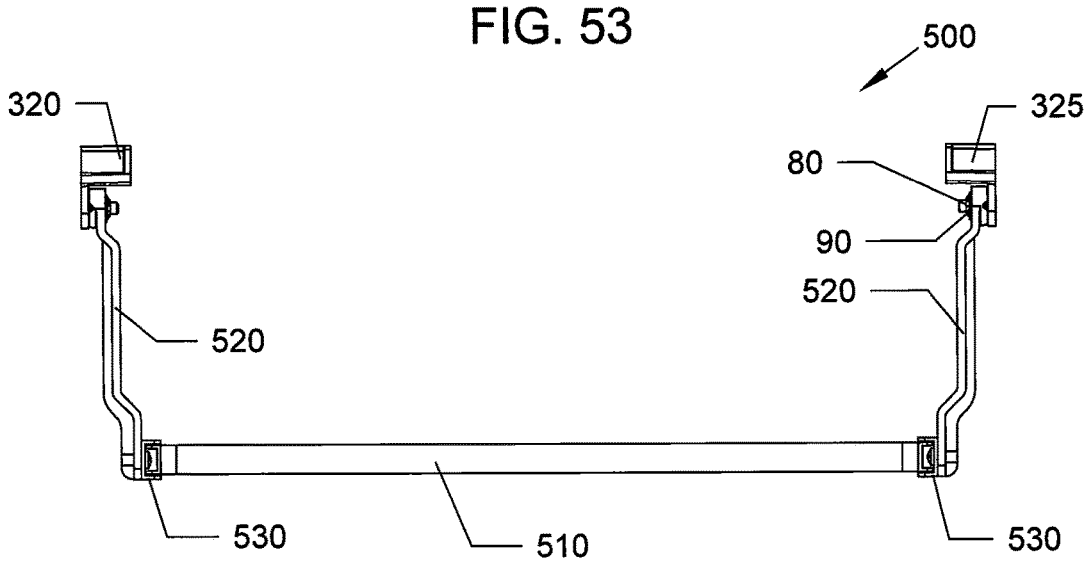

FIG. 53 is a front view of the assembly of FIG. 47.

Figure 54:
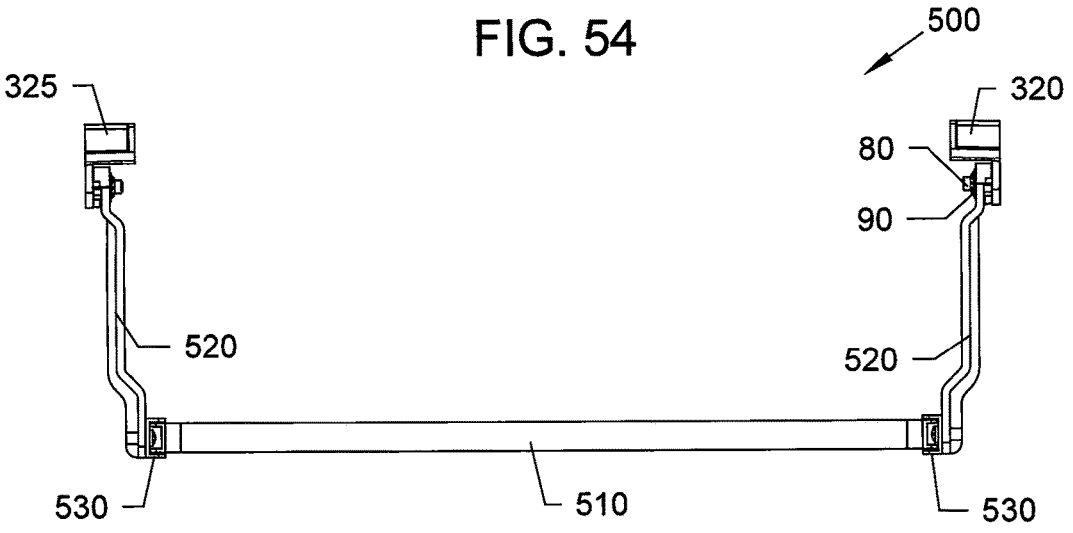

FIG. 54 is a rear view of the assembly of FIG. 47.

Figure 55:
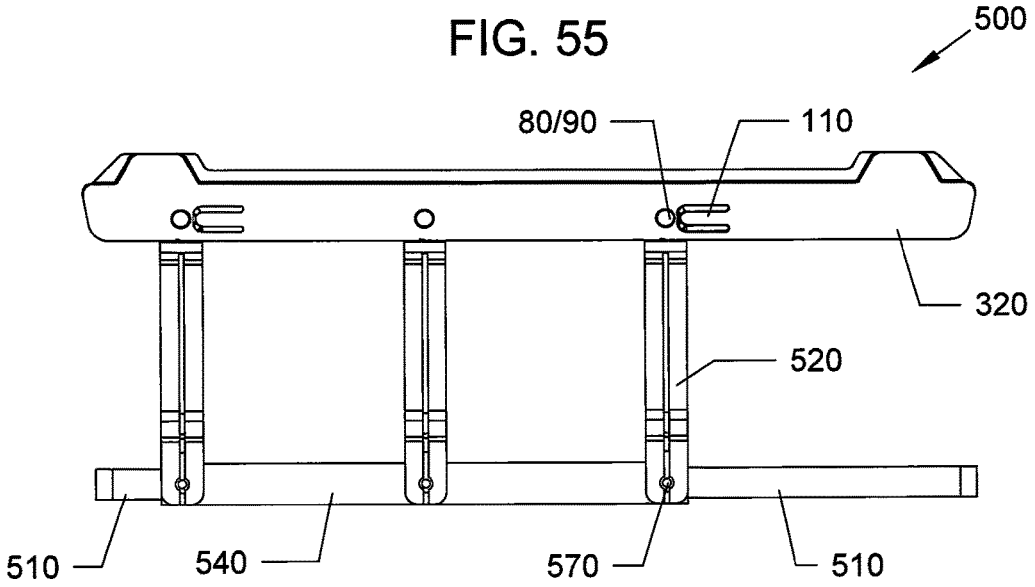

FIG. 55 is a left side view of the assembly of FIG. 47.

Figure 56:
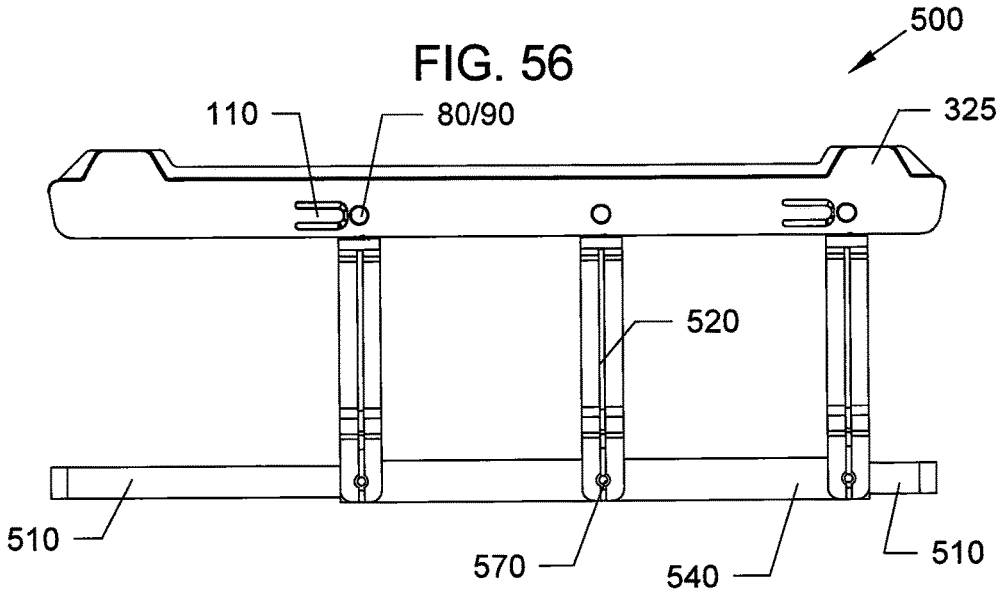

FIG. 56 is a right side view of the assembly of FIG. 47.

Figure 57:
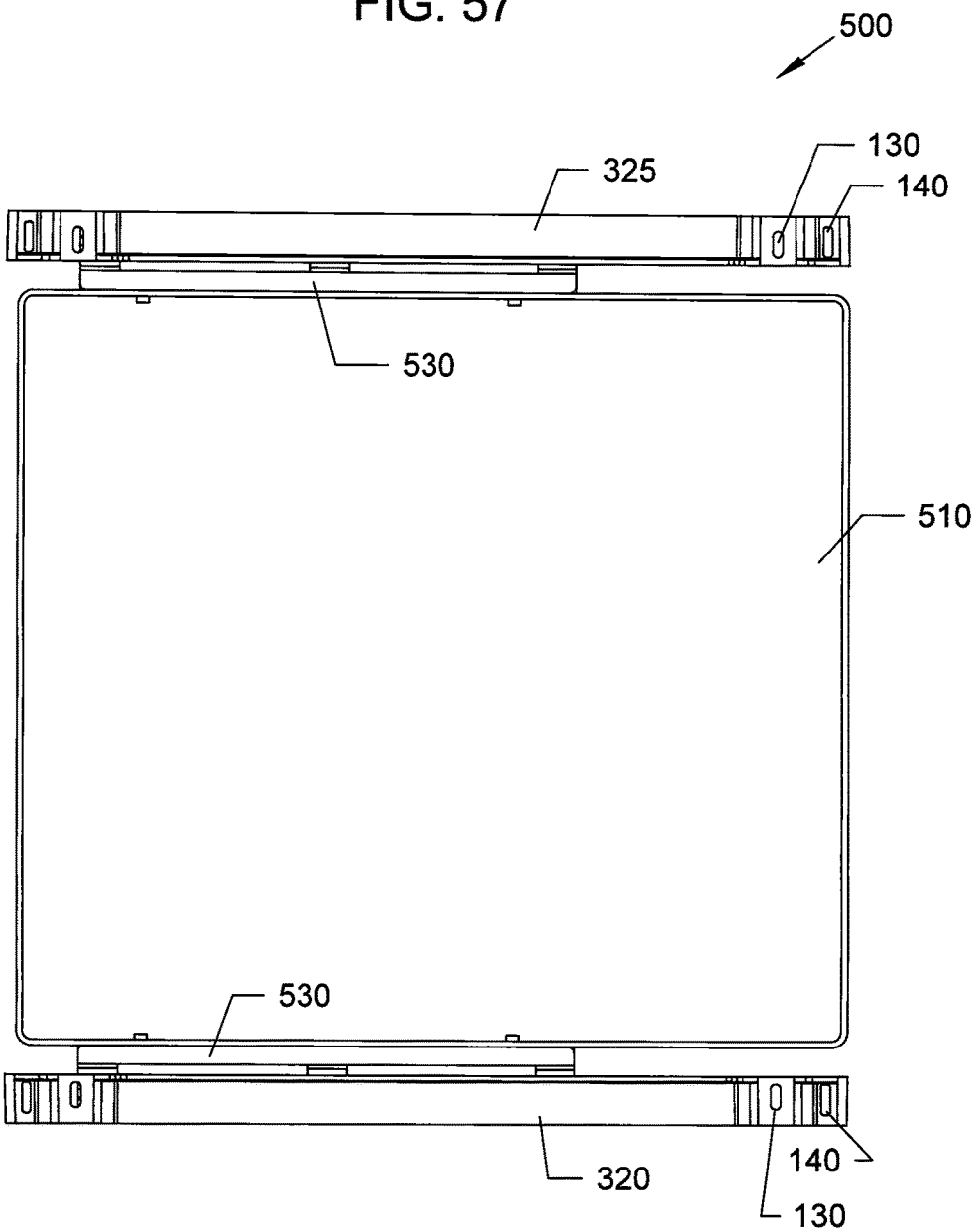

FIG. 57 is a top view of the assembly of FIG. 47.

Figure 58:
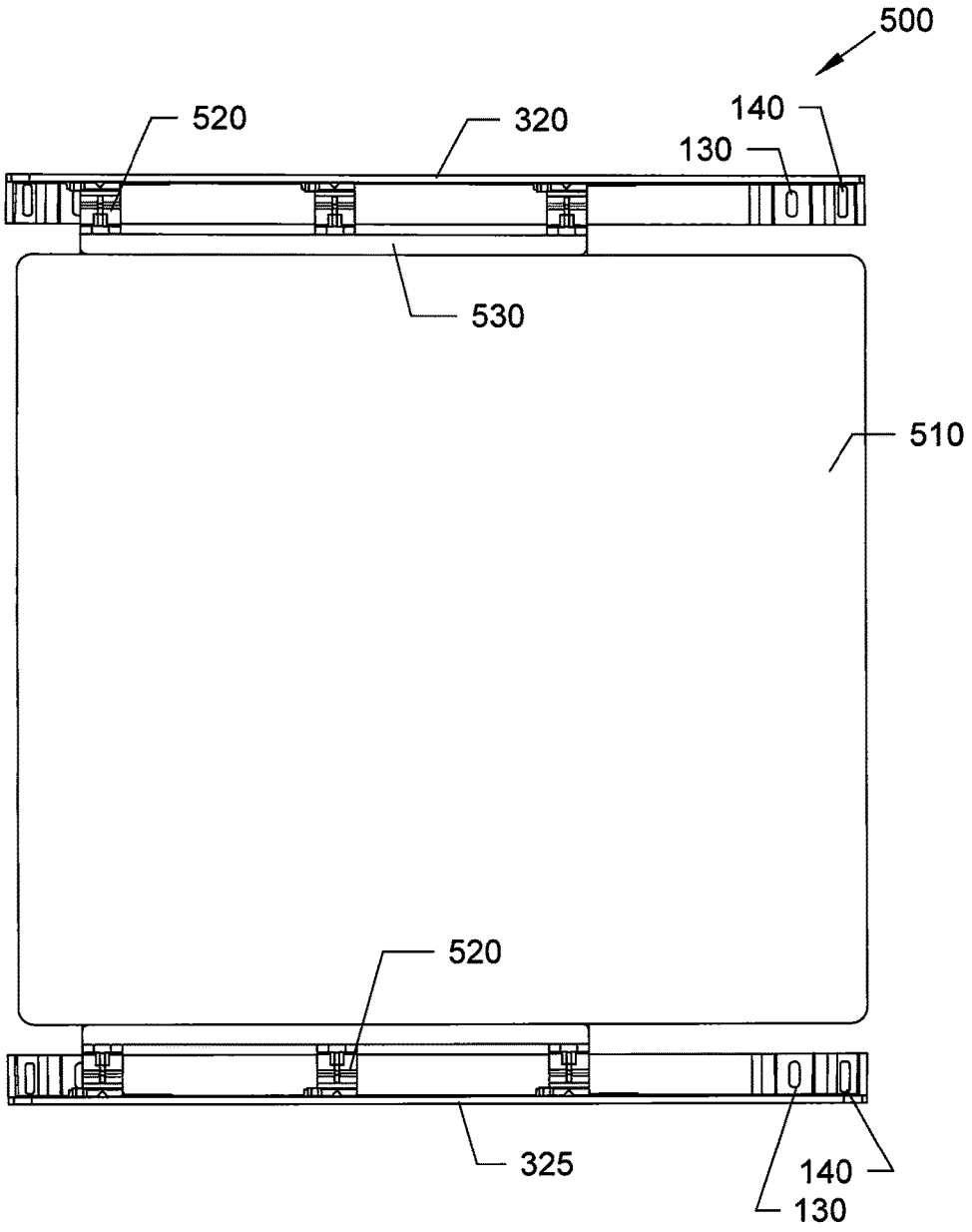

FIG. 58 is a bottom view of the assembly of FIG. 47.

DESCRIPTION OF THE PREFERRED EMBODIMENTS

Before explaining the disclosed embodiments of the present invention in detail it is to be understood that the invention is not limited in its applications to the details of the particular arrangements shown since the invention is capable of other embodiments. Also, the terminology used herein is for the purpose of description and not of limitation.

In the Summary above and in the Detailed Description of Preferred Embodiments and in the accompanying drawings, reference is made to particular features (including method steps) of the invention. It is to be understood that the disclosure of the invention in this specification does not include all possible combinations of such particular features. For example, where a particular feature is disclosed in the context of a particular aspect or embodiment of the invention, that feature can also be used, to the extent possible, in combination with and/or in the context of other particular aspects and embodiments of the invention, and in the invention generally.

In this section, some embodiments of the invention will be described more fully with reference to the accompanying drawings, in which preferred embodiments of the invention are shown. This invention may, however, be embodied in many different forms and should not be construed as limited to the embodiments set forth herein. Rather, these embodiments are provided so that this disclosure will be thorough and complete, and will convey the scope of the invention to those skilled in the art. Like numbers refer to like elements throughout, and prime notation is used to indicate similar elements in alternative embodiments.

A list of components will now be described.

10 Fold-down wine bottle storage assembly.

20 Left hand mount bracket for two bail cradles which can be strapped, clamped, or screwed to an existing shelf in a refrigerator or cabinet.

25 Right hand mount bracket has same features as the left hand bracket.

30 Swing-down bail cradles wine bottles.

40 Bar link ties two bails together for coordinated movement and strength.

50 Strap with buckle threads through the mount brackets and wraps around shelf. Adjustable buckle secures assembly to the shelf.

55 free ends of straps

60 Refrigerator shelf.

70 Adjustable strap buckle.

80 Captive pin used to assemble pivoting parts.

90 Captive nut used to secure pin.

100 Wine bottle.

110 Locking finger engages indents on bail locking the bails up or down.

120 Back stop tabs located on the inside of the mount bracket prevent over-travel of the bails when they are in the down position.
130 Slots in the mount brackets for screw-mount of the brackets to a shelf.
132 upper protrusions on brackets 20, 25
140 Slots in the mount brackets enable a strap or cable to be threaded through for shelf mounting.
150 Stop ear on the bail engages the stop tab on the inside of the mount bracket for over-travel prevention.
160 detents on the bail engage the locking fingers of the mount brackets to lock the bail down or up.
170 Protrusion on the locking finger fits into the indent on the mount bracket to create the bail locking feature.
190 Cabinet shelf.
200 Shelf mounting screw.
210 Alternate screw clamping mount assembly for mounting bracket.
220 Alternate spring clamping mount assembly for mounting bracket.
230 Threaded screw clamp mount hook.
232 hook end
240 Washer.
250 Hex nut.
260 Spring clamp mount hook.
262 hook end
265 Compression spring provides clamping force.
270 Fold-down multi-use storage assembly.
280 Swing-down multi-use bail incorporates free rotating balls to ease the loading and unloading of the accessory shelf or pre-packaged beverages.
290 Rotating ball is retained in a cavity in the multi-use bail.
300 Anti-tip tabs protrudes from the inside of the multi-use bail to keep the accessory shelf from pitching forward or backward if it is unevenly loaded.
310 Bar link ties three bails together for coordinated movement and strength.
320 Left hand mount bracket for three bails has the same mounting options as the two-bail bracket.
325 Right hand mount bracket has the same features as the left hand bracket.
330 Accessory shelf. The shelf has ribs on one side to help locate different beverage packages and ribs on the other side to support a plate or serving tray.
340 Ball track on accessory shelf.
350 ribs on accessory shelf.
360 Compartment on accessory shelf for a can, bottle, or wine opening tool.
370 This side of the accessory shelf has ribs to support a plate or serving tray.
380 This side of the tray has ribs to separate different beverage packages.
410 Multiple detents along the edges of the ball tracks to provide cavities that the rolling ball in the bails can occupy in order to provide locating stops to the accessory tray in its travel.
420 Cavity in multi-use bail for free rotating ball.
430 Beverage can 24 pack.
440 Beverage can 12 pack.
450 Wine screw. Prior art.
460 Beverage can.
470 Beverage bottle.
472 Swing-down bail with long roller to ease loading and unloading of the accessory shelf and or other cargo.
475 Roller.
480 Swing-down bail with raised ribs to ease loading.
490 Raised ribs on swing-down bail.
500 Fold-down storage assembly with attached, slide-out, shelf.
510 Slide-out shelf/tray attached to drawer slides that are attached to swing-down legs.
520 Swing-down legs attach mounting brackets to drawer slides.
530 Drawer slide assembly.
540 Outer race of drawer slide.
550 Inner race of drawer slide.
570 Screws that attach the outer race of the drawer slide to the swing-down legs.
580 Screws that attach the inner race of the drawer slide to the
590 Nut attached to shelf for attachment screw.

First Embodiment

Figure 1:
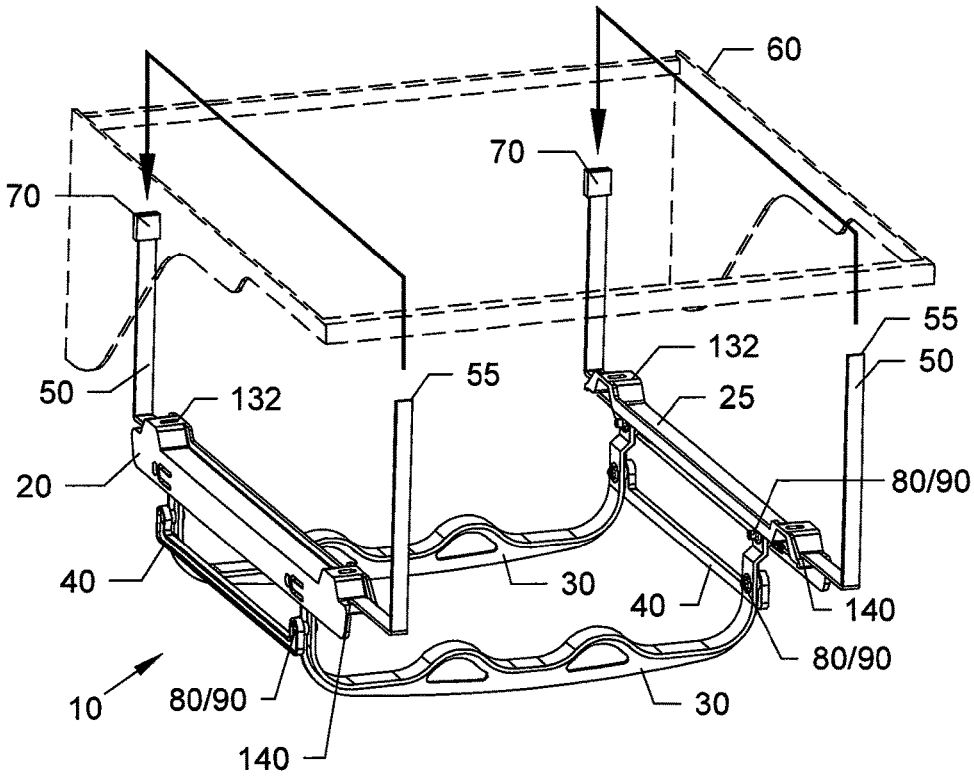
FIG. 1 is a top perspective view of fold-down storage assembly ready to attach to a shelf with straps.
Figure 2:
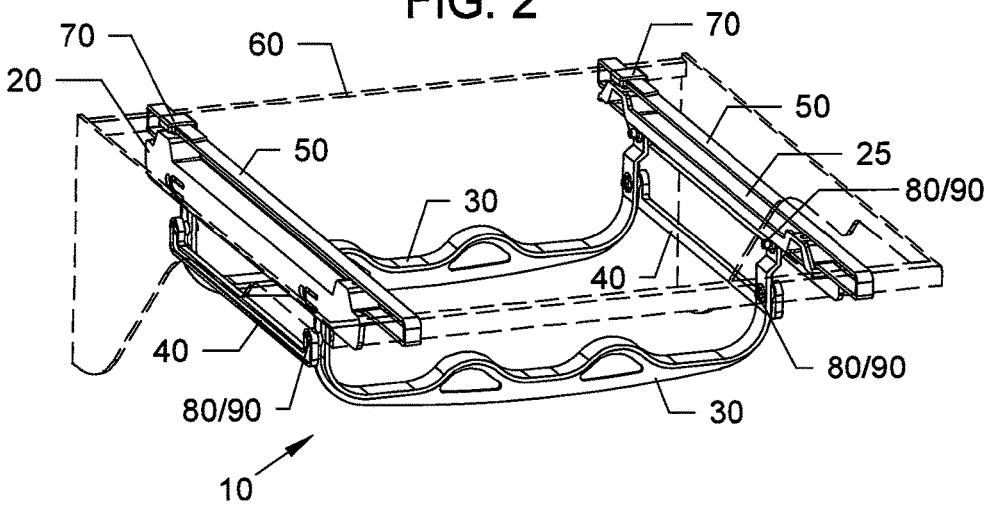
FIG. 2 is a perspective view of FIG. 1 with the assembly attached to the shelf.
Figure 3:
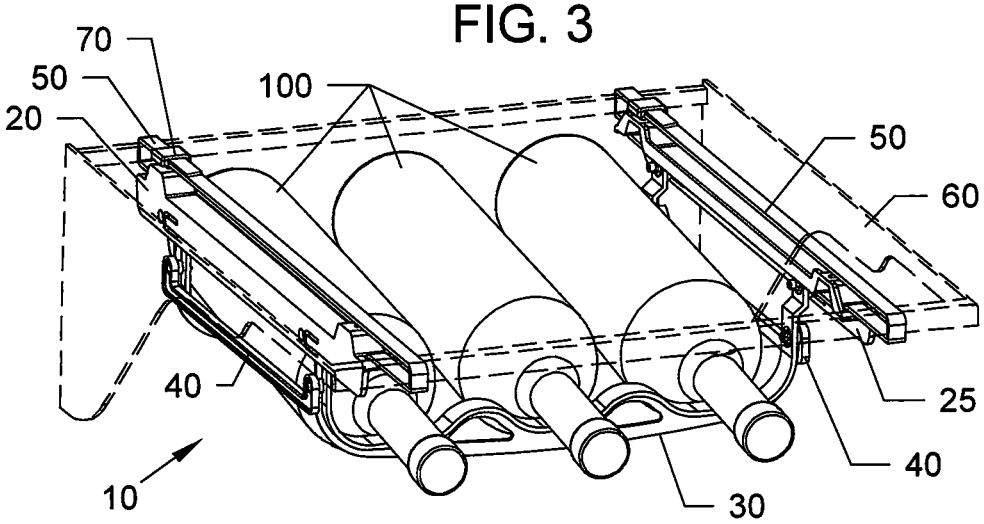
FIG. 3 is another perspective view of the assembly of FIG. 2 with wine bottles stored with necks aimed forward. Bottles are stored with necks forward.

FIG. 1 is a top perspective view of fold-down storage assembly 10 ready to attach to a shelf 60 with a pair of straps 50 that can be used to store wine bottles. FIG. 2 is a perspective view of FIG. 1 with the assembly 10 attached to the shelf 60. FIG. 3 is another perspective view of the assembly 10 of FIG. 2 with wine bottles 100 stored with their neck ends aimed forward.

Figure 4:
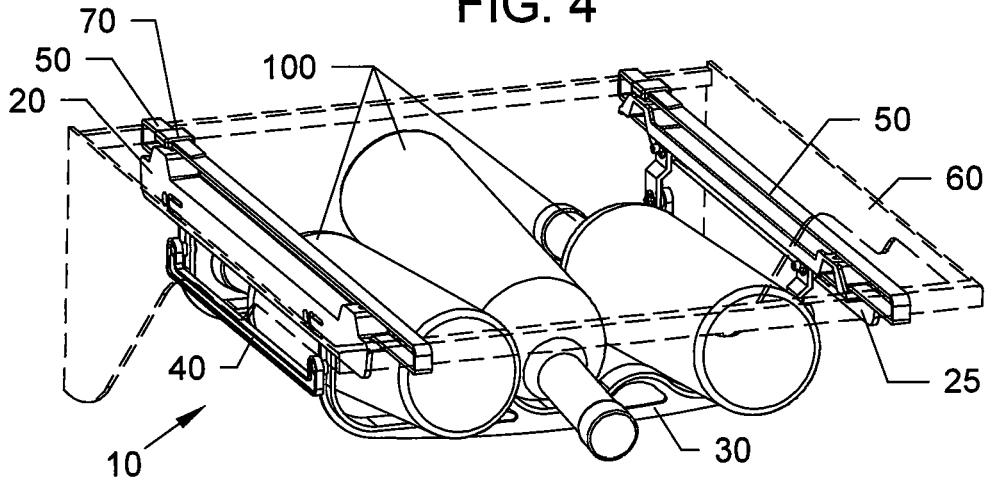
FIG. 4 is another perspective view of the assembly of FIG. 3 with stored wine bottles having their orientation being staggered.

FIG. 4 is another perspective view of the assembly 10 of FIG. 3 with stored wine bottles 100 having their orientations being staggered with some neck ends extending inward and at least one neck end extending outward.

Referring to FIGS. 1-4 and 9 each strap 50 can have one end with an adjustable strap buckle 70 and an opposite free end 55. Each strap can pass through slots 140 at each end of a left hand mount bracket 20 and a right hand mount bracket 25. The free ends 55 of the straps 50 can pass about a front portion of a shelf 60, such as but not limited to a refrigerator shelf, a lower shelf portion of a cabinet or another type of shelf. The free ends 55 of the straps 50 can then pass into adjustable strap buckles 70 and tightened so that the upper protrusions 132 of the left mount bracket 20 and right bracket 25 abut against a lower surface edge of the shelf 60.

Figure 5:
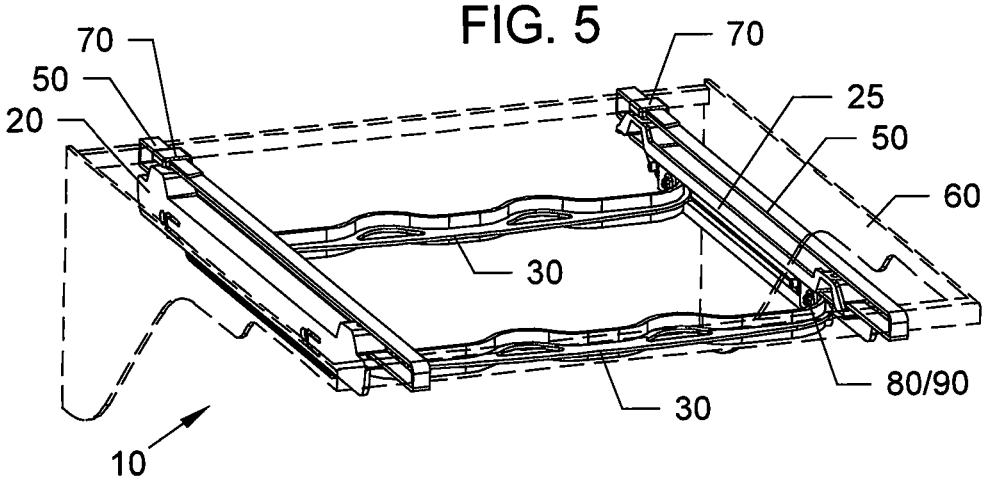
FIG. 5 is a perspective view of the assembly of the preceding figures with the bail cradles folded up.
Figure 6:
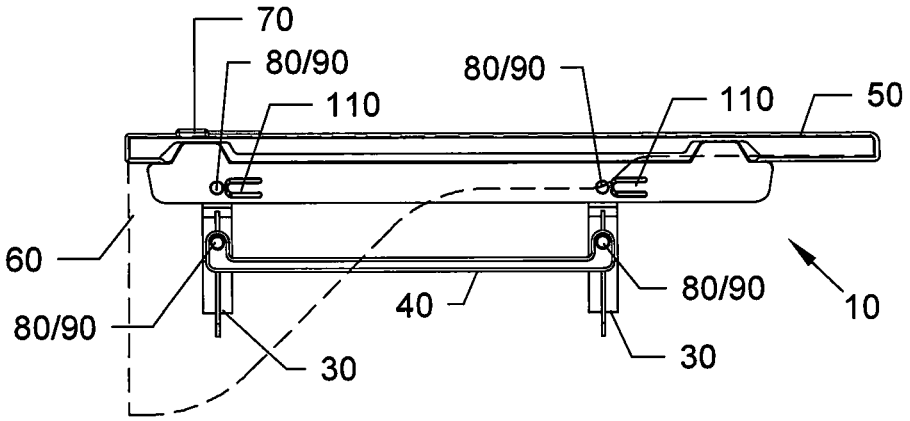
FIG. 6 is a side view of the storage assembly of the preceding figures attached to a shelf with the bail cradles in a downward position.
Figure 7:
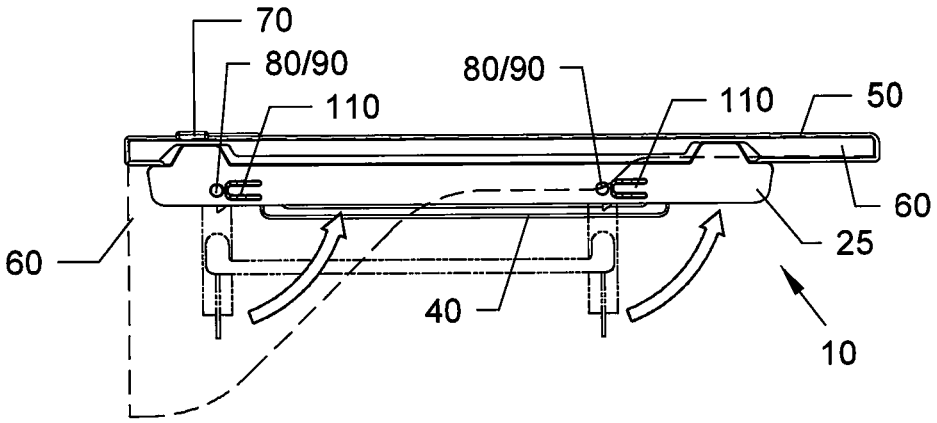
FIG. 7 is another side view of the storage assembly of FIG. 6 with the bail cradles folded up.

FIG. 5 is a perspective view of the assembly 10 of the preceding figures with the pair of bail cradles 30 folded up. FIG. 6 is a side view of the storage assembly 10 of the preceding figures attached to a shelf 60 with the bail cradles 30 in a downward position. FIG. 7 is another side view of the storage assembly 10 of FIG. 6 with the bail cradles 30 folded up.

Figure 8:
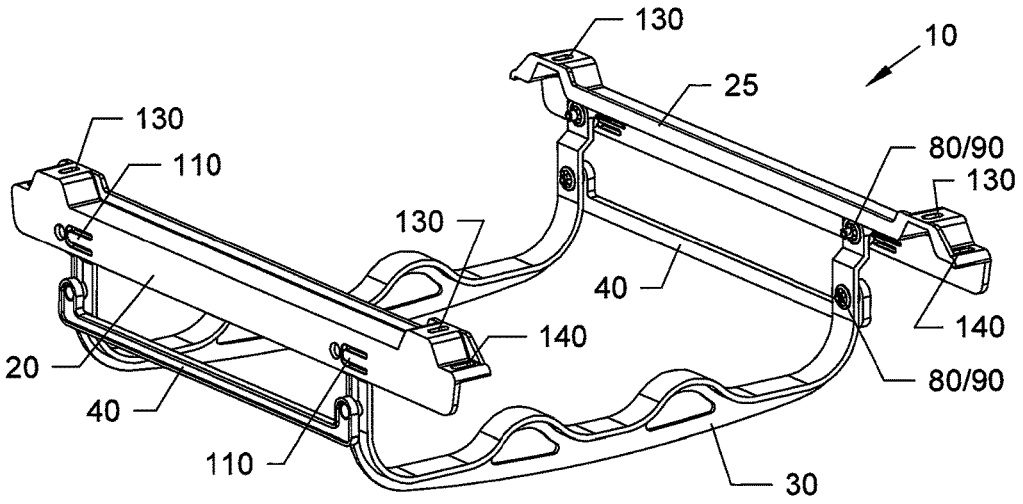
FIG. 8 is a top perspective view of the storage assembly of the preceding figures not attached to a shelf.

FIG. 8 is a top perspective view of the storage assembly 10 of the preceding figures not attached to a shelf 60.

Figure 9:
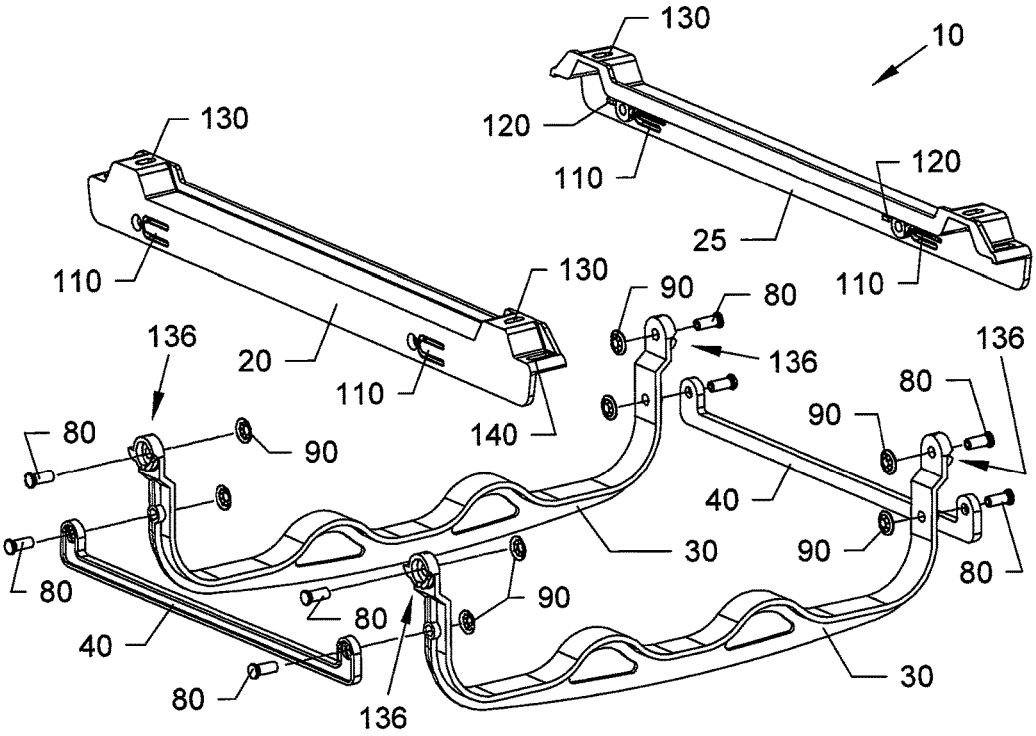
FIG. 9 is an exploded view of the storage assembly of the preceding figures.

FIG. 9 is an exploded view of the storage assembly 10 of the preceding figures.

Figure 10:
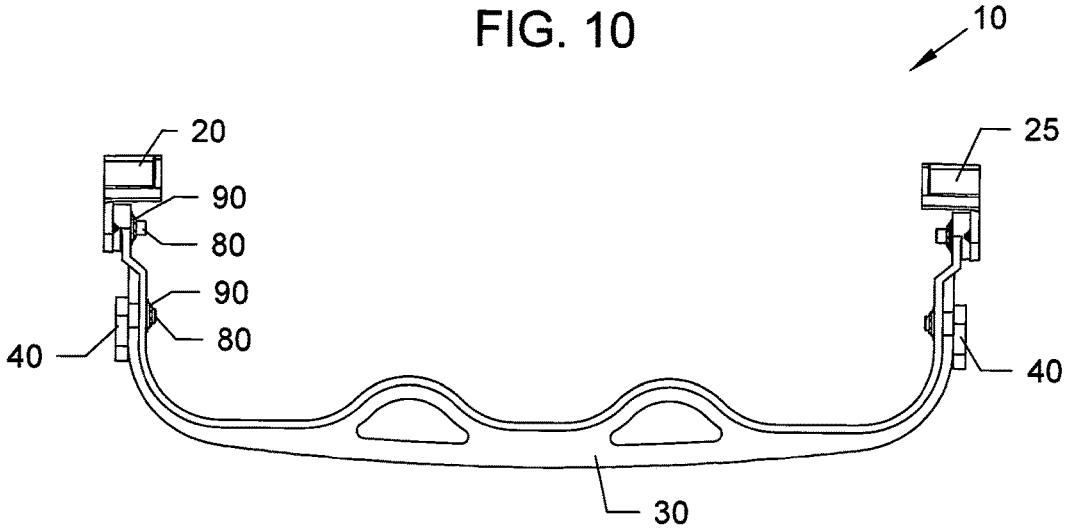
FIG. 10 is a front view of the storage assembly of FIG. 8.
Figure 11:
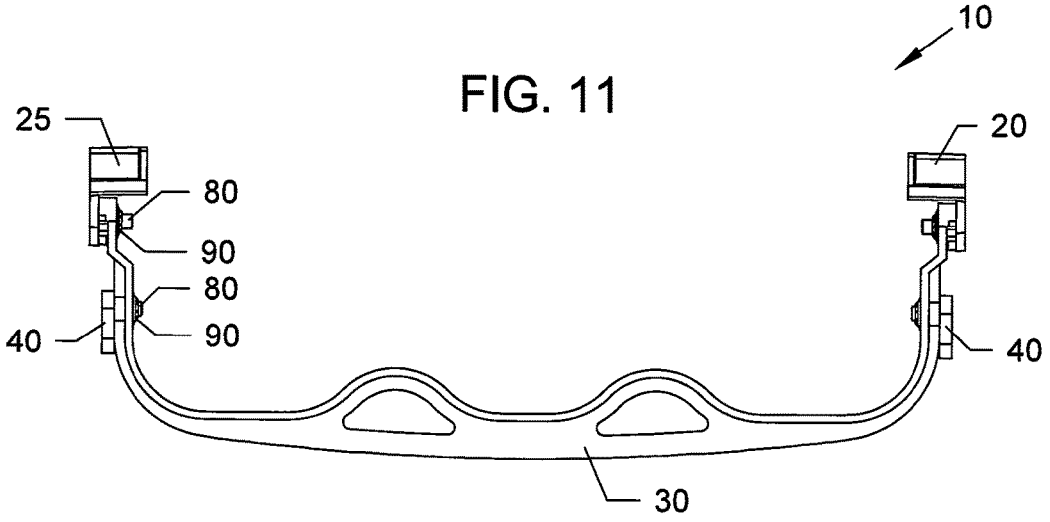
FIG. 11 is a rear view of the storage assembly of FIG. 8.
Figure 12:
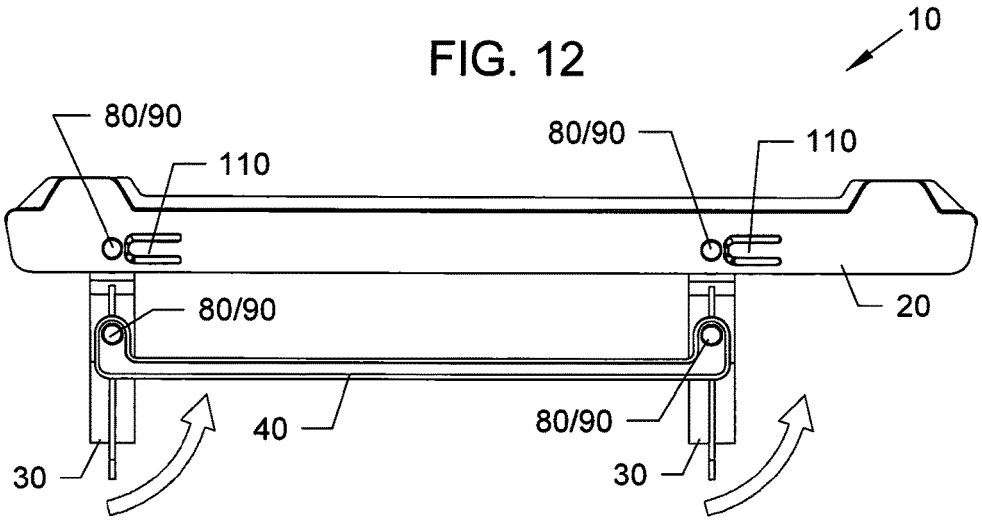
FIG. 12 is a left side view of the storage assembly of FIG. 8.
Figure 13:
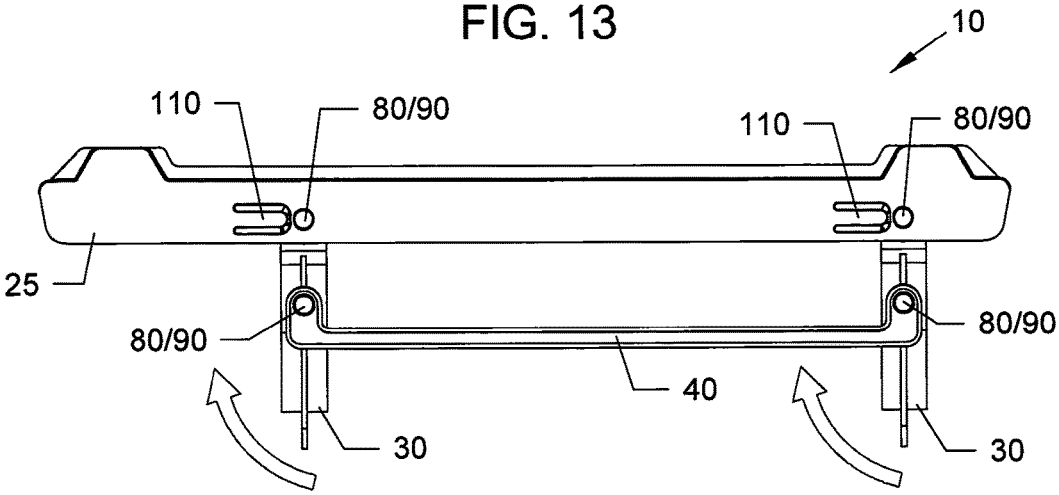
FIG. 13 is a right side view of the storage assembly of FIG. 8.
Figure 14:
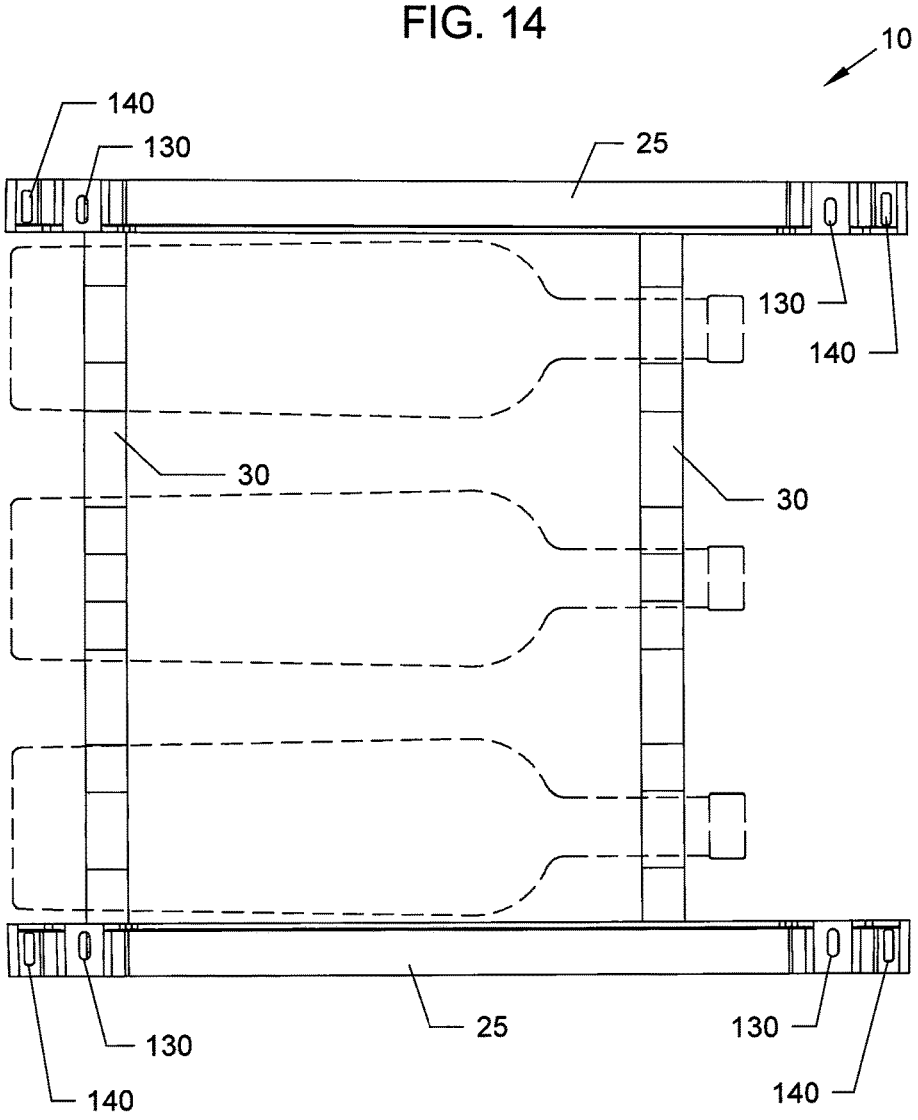
FIG. 14 is a top view of the storage assembly of FIG. 8 with wine bottles in dotted lines.
Figure 15:
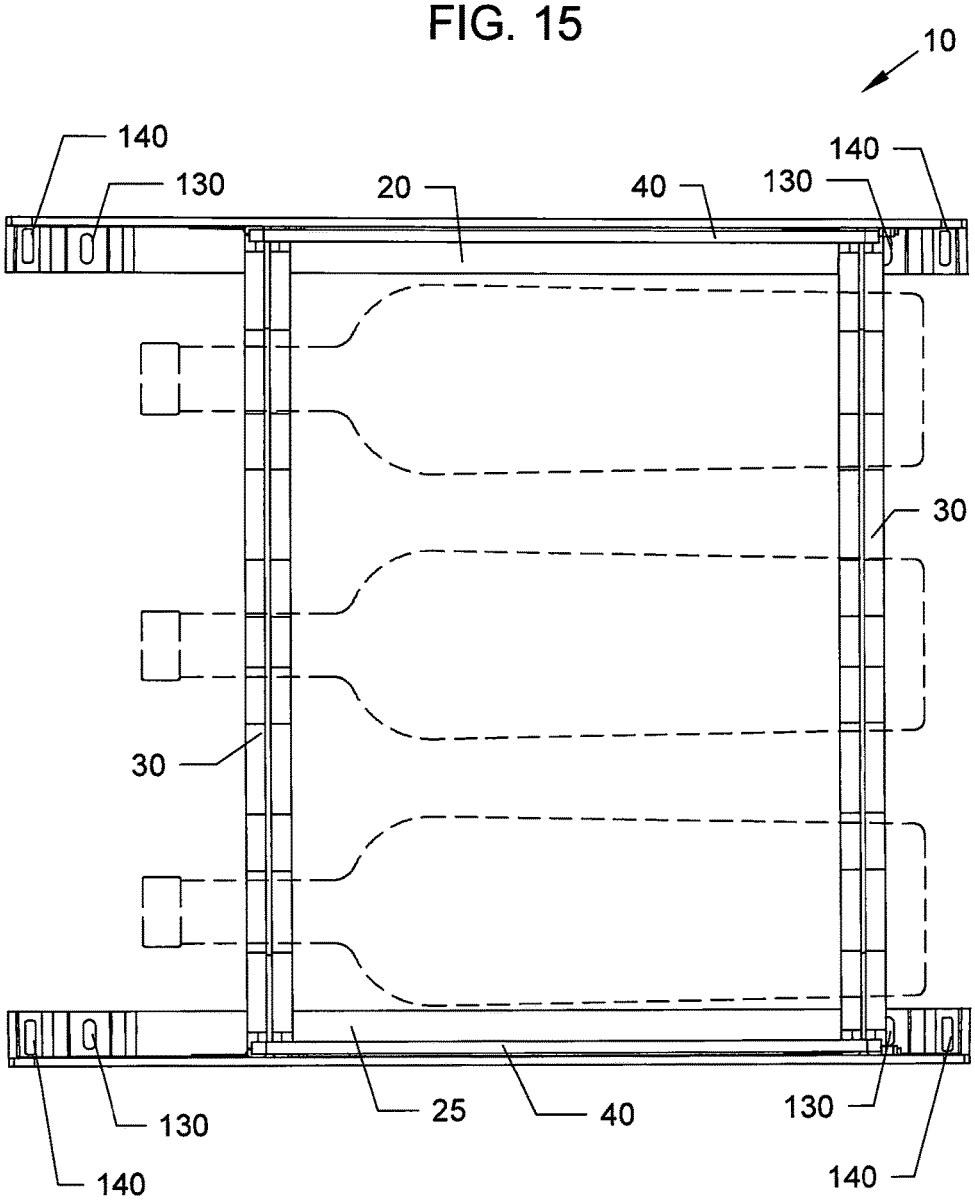
FIG. 15 is a bottom view of the storage assembly of FIG. 14 with wine bottles.

FIG. 10 is a front view of the storage assembly 10 of FIG. 8. FIG. 11 is a rear view of the storage assembly 10 of FIG. 8. FIG. 12 is a left side view of the storage assembly 10 of FIG. 8. FIG. 13 is a right side view of the storage assembly 10 of FIG. 8. FIG. 14 is a top view of the storage assembly 10 of FIG. 8 with wine bottles 100 in dotted lines. FIG. 15 is a bottom view of the storage assembly 10 of FIG. 14 with the wine bottles 100.

Referring to FIGS. 1-15, the assembly 10 can include a pair of swing down bail cradles 30 that are pivotally attached at their ends to the right hand bracket 20 and left hand bracket 25. In a preferred embodiment, a top surface of each of the bail cradles 30 can have a plurality of side by side concave curved indentations which allow for bottles such as wine bottles 100 to be stored and spaced apart from one another in a stable and safe positions.

Referring to FIGS. 6-13, the parallel spaced apart mount brackets 20, 25 can each have back stop tabs 120 located on an inside surface area of each mount bracket 20, 25 to prevent over-travel of the swinging bail cradles 30 when they are in the down position. (FIGS. 6-8, 12-13). The upper portions of the vertical ends of the bail cradles 30 can have pivoting rings 136 that can each include a stop ear 150 that engages a respective stop tab 120 on the inside of each mount brackets 120, 125 for over-travel prevention. Captive pin(s) 80 can be used to assembly the pivot rings 136 on each bail cradle 30 that are pivotally attached to brackets 20, 25 with respective captive nut(s) 90.

Bar link ties (arms) 40 can each have L shaped ends with through holes that can be pivotally attached to end leg portions of the bail cradles 30 by additional captive pins 80 that also pass into holes in brackets 20, 25 and pivotally held in place by captive nuts 90. The bar arms 40 allow for the bail cradles 30 to remain continuously parallel to one another and to pivot from a downward position extending below the brackets 20, 25 to a folded up position and back.

Figure 16:
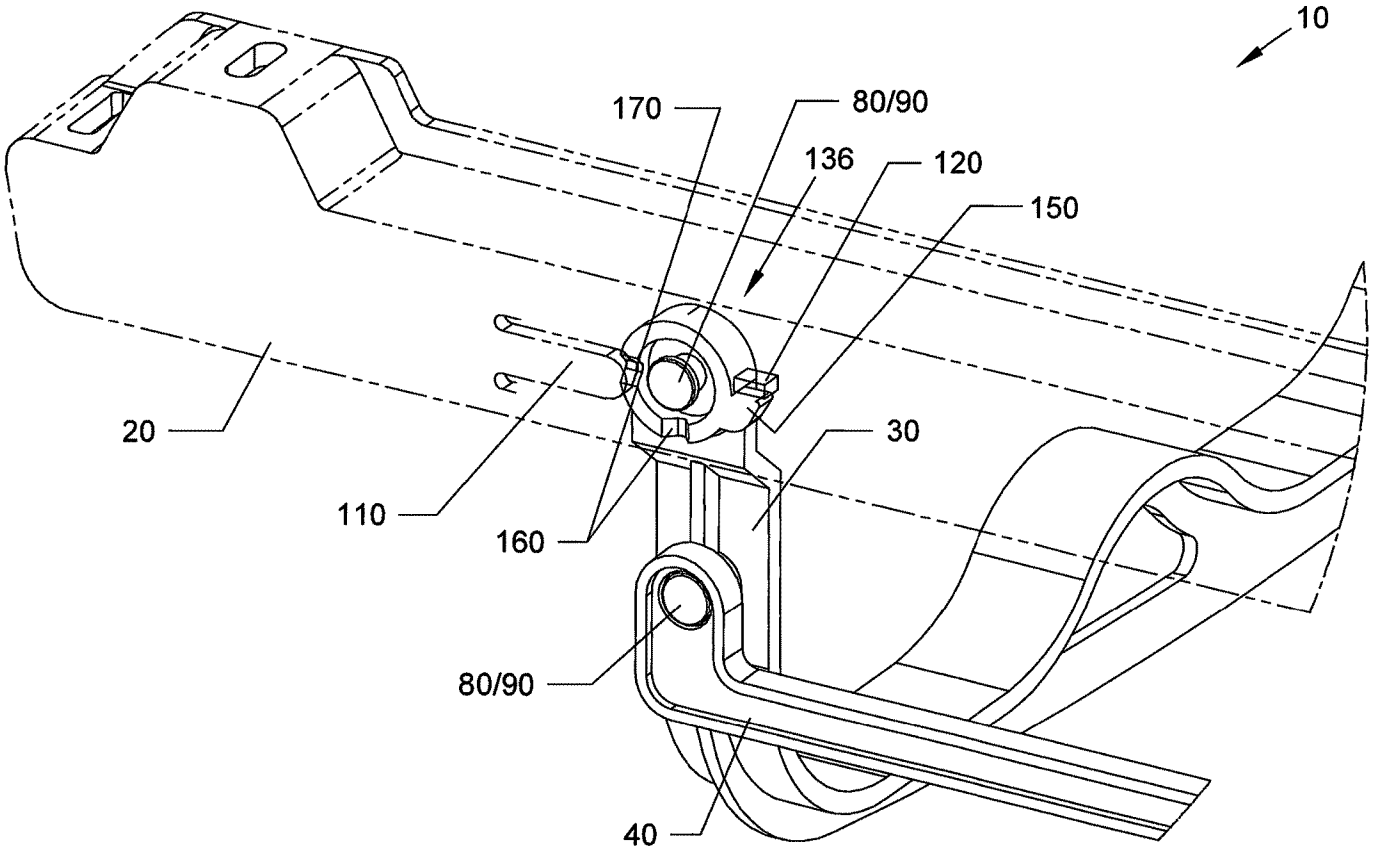
FIG. 16 is an enlarged view of the bail locking components for the cradle bails in a locked down mode.

FIG. 16 is an enlarged view of the bail locking components for the bail cradles 30 in a locked down mode. The mounting bracket 20 is shown in phantom lines so the features can be seen. The protrusion on the locking finger 110 is seated into a bail detent 160 locking the bail cradle 30 in the down position.

Figure 17:
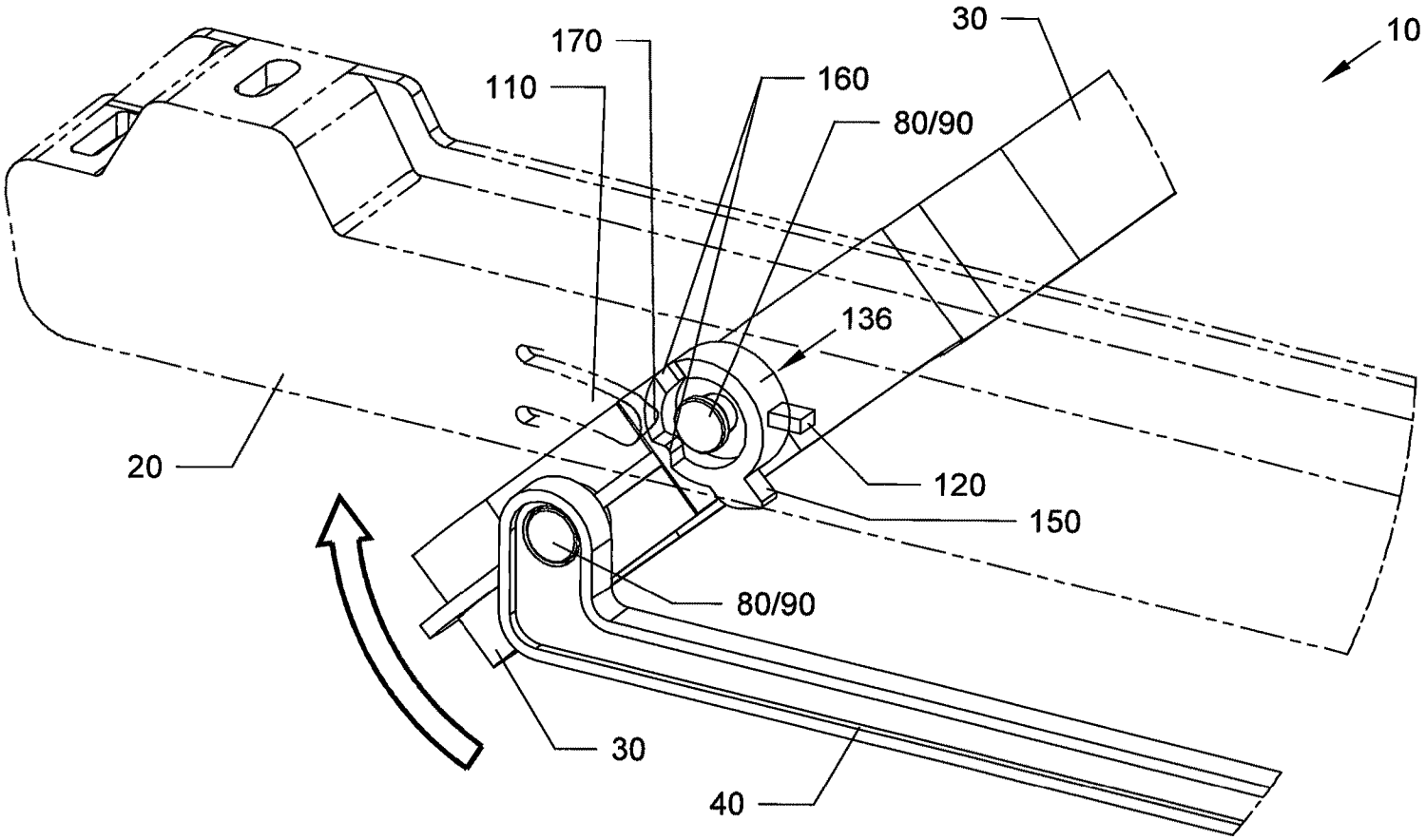
FIG. 17 is another view of FIG. 16 with the cradle bail traveling to the folded up configuration.

FIG. 17 is another view of FIG. 16 with the cradle bail 30 traveling to the folded up configuration. The locking finger 110 is flexed and the locking finger protrusion 170 is not seated in a bail detent 160.

Figure 18:
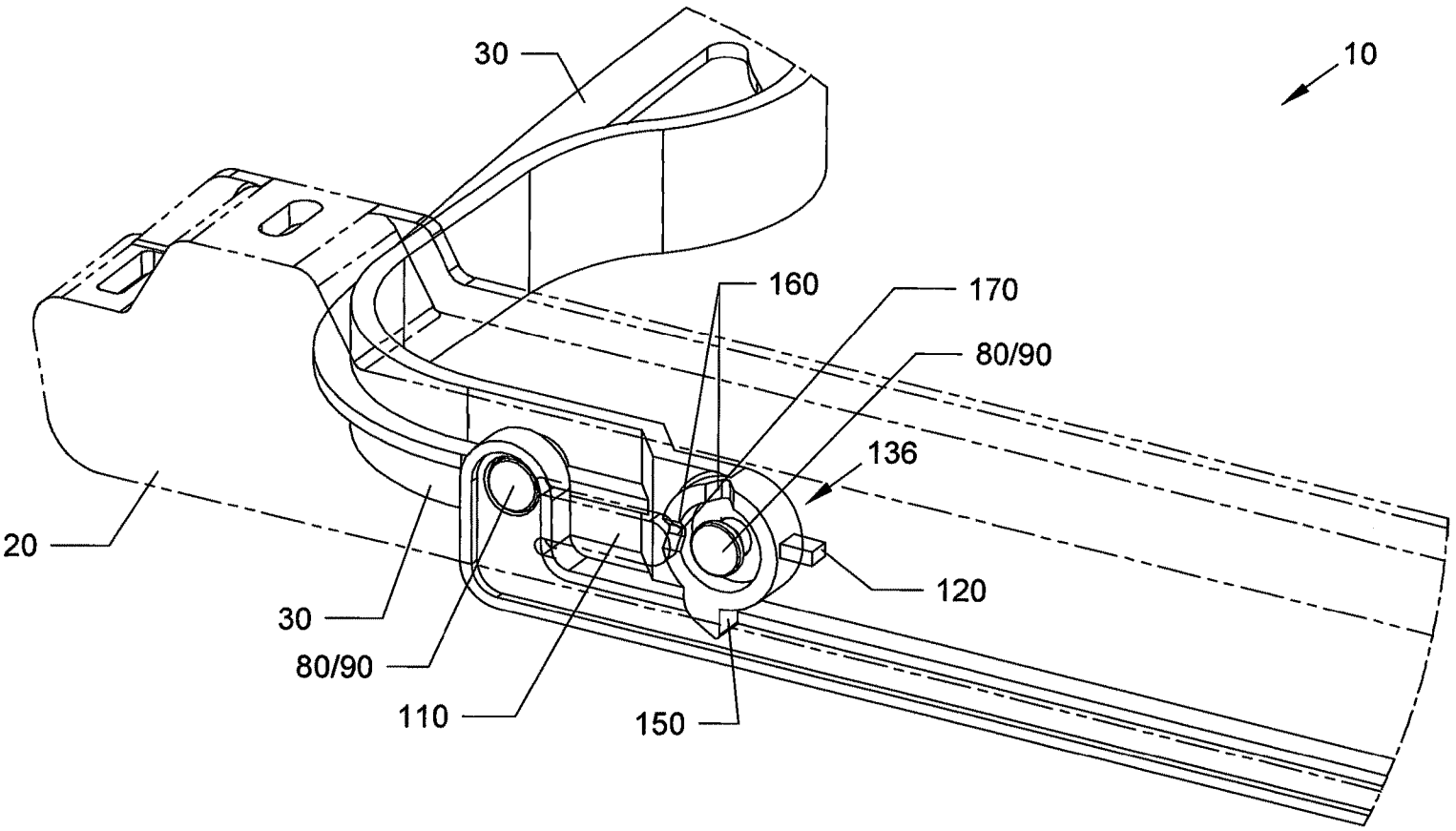
FIG. 18 is another view of FIG. 16 with the cradle bail rotated 90 degrees to the folded up configuration.

FIG. 18 is another view of FIG. 16 with the cradle bail 30 rotated 90 degrees to the folded up configuration. The protrusion 170 on the locking finger 110 is seated into a bail detent 160 locking the bail cradle 30 in the up position. To move the bail cradles 30, continuous pressure allows for the protrusion 170 on the flexible locking finger 110 to move in and out of the detent 160 to allow the bail cradles 30 to move from the locked down position to the locked up position and in reverse.

Figure 19:
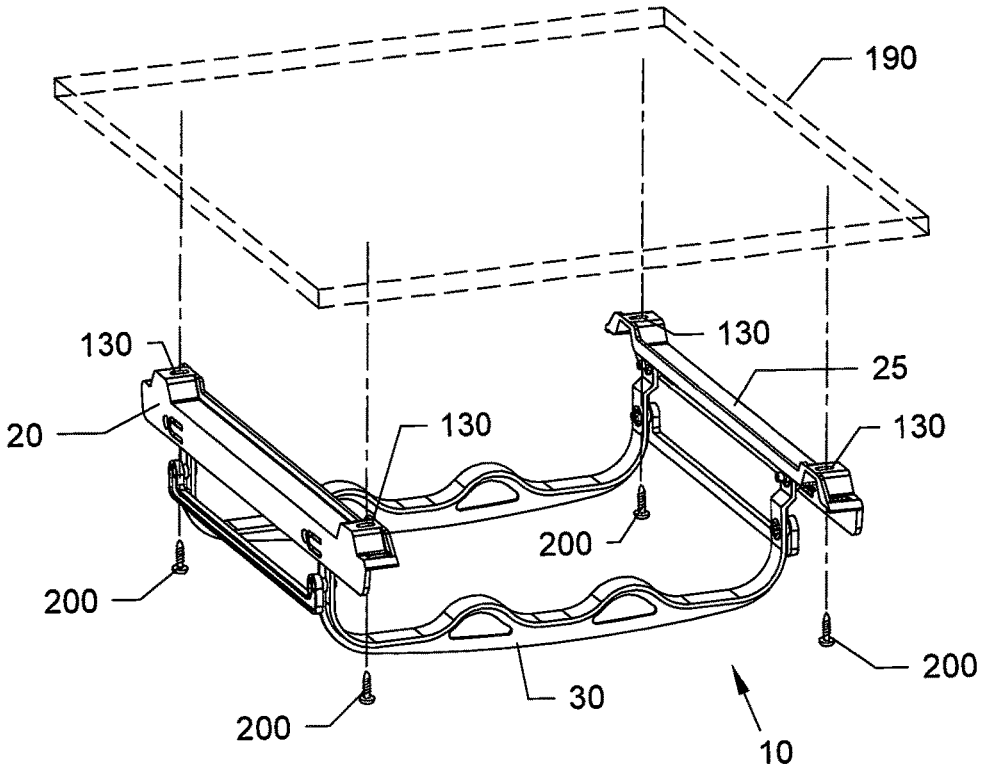
FIG. 19 is a top perspective view of the assembly of FIG. 1 shown ready to attach to a shelf with screws.
Figure 20:
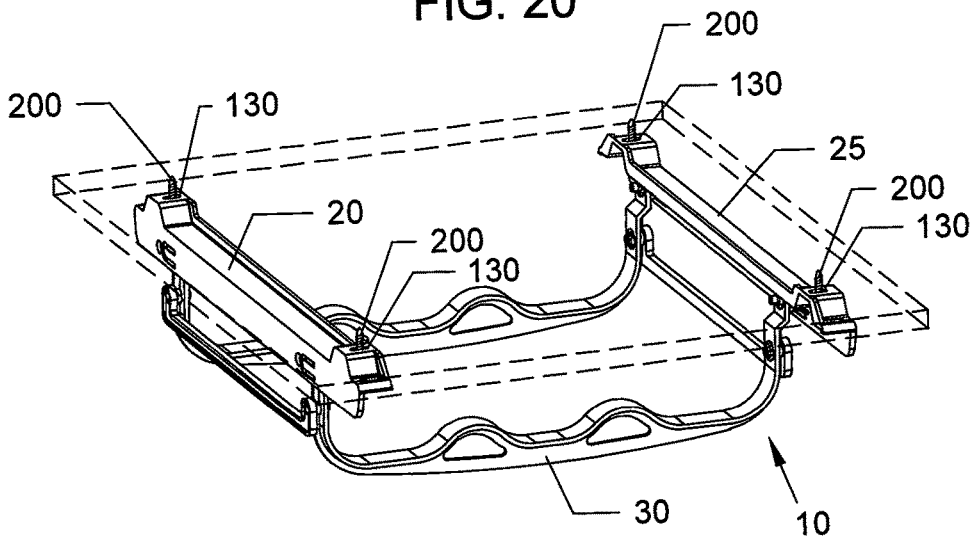
FIG. 20 is another view of the assembly of FIG. 19 attached to the shelf.

FIG. 19 is a top perspective view of the assembly 10 of FIG. 1 shown ready to attach to a shelf 190 with screws 200. FIG. 20 is another view of the assembly 10 of FIG. 19 attached to the shelf 190 with screws 100 passing through slots 130 in the upper protrusion ends 132 of the brackets 20, 25 and into lower surfaces of the shelf 190.

Figure 21:
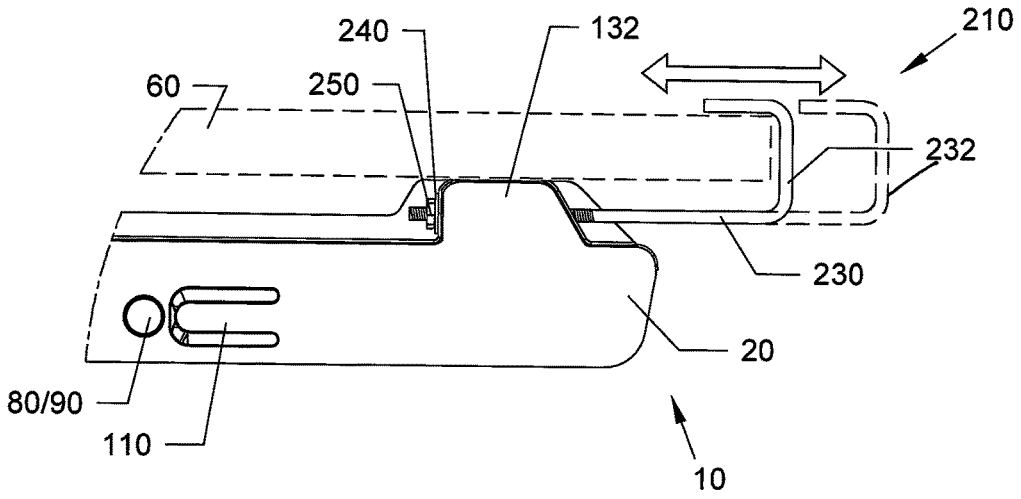
FIG. 21 is an enlarged side view of the FIG. 1 assembly with an alternate mounting embodiment.

FIG. 21 is an enlarged side view of the FIG. 1 assembly with an alternate mounting embodiment 210 for a shelf 60 with a screw 230 having a threaded end that passes through the upper protrusions 132 of bracket 20/25 held in place by a nut 250 and washer 240. The hook end 232 attached about the outer edge of a shelf 60. The nut 250 can be manually used to tighten the hook 232 onto an end of the shelf 60. When nut 250 is tightened, protrusion 132 abuts against the underside of shelf 60 adding stability to the side brackets and cradles 30.

Figure 22:
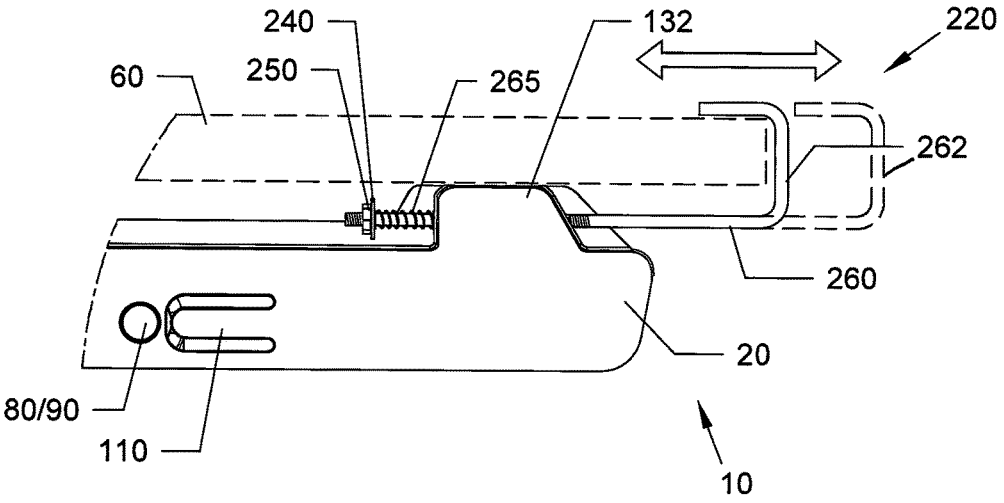
FIG. 22 is another enlarged side view the FIG. 1 assembly with another alternate mounting embodiment with a spring loaded hook.

FIG. 22 is another enlarged side view the FIG. 1 assembly with another alternate mounting embodiment 220 with a spring loaded hook 260 having a hook end 262 on an outer edge of a shelf 60. A compression spring 265 about the threaded end is can be located between the upper protrusions 132 and the washer 240 and nut 250. Spring 265 eliminates having to tighten nut 250 to secure the side brackets to the underside of shelf 60. Embodiments 210, 220 allow for easy removal of the assemblies and allow for use with the different variations of dimensions of shelves 60.

Second Embodiment

FIG. 23 is a top perspective view of a second embodiment of a fold-down storage assembly 270 with a sliding shelf ready to accept packaged 12 or 24 packs of canned beverage or an optional accessory shelf. The accessory shelf 330 is show ready to slide onto the bail cradles 280 of the assembly 270. The assembly 270 can have three pivoting bail cradles 280 that pivot relative to a left hand bracket 320 and a right hand bracket 325, along with two bark link ties (arms) 310 that can function similar to like components in the previous embodiment. The optional accessory shelf is not necessary to store 12 or 24 packs of beverages.

The bail cradles 280 can have rolling balls 290 spaced underneath anti-tip tabs 300 at the extreme ends of the bottom member of each bail cradle 280 that engage with ball tracks 340 on the accessory shelf 330. The anti-tip tabs 300 protrude from the inside of the multi-use bail cradles 280 to keep the accessory shelf 330 from pitching forward or backward if it is unevenly loaded.

FIG. 24 is another view of FIG. 23 with the accessory shelf 330 resting on the bail cradles 280. The top side of the accessory shelf 330 is shown.

Referring to FIGS. 23-24, the top side of the accessory shelf 330 can have a rib pattern 380 with separate ribs 350 to separate different beverage such as but not limited to beverage bottles and cans. On the shelf 330 can be a compartment 360 which can be used to storing a can, bottle, or wine opening tool, such as but not limited to a corkscrew, can opener, bottle opener, and the like. A plurality of detents 410 can be located along the edges of the ball tracks 340 to provide cavities so that the rolling balls 290 in the bail cradles 280 can occupy in order to provide locating stops to the accessory tray 330 in its' travel.

FIG. 25 is another view of FIG. 24 with the accessory shelf 330 turned upside down showing the bottom side 370 having a rib pattern such as but not limited to a ring pattern designed to support serving plates, and the like.

FIG. 26 is an enlarged view of a section of FIG. 25 showing track 410 detail on the accessory shelf 330 with multiple detents 410 along both top edges of the track 410. These detents 410 allow the balls 290 to seat and resist forward and backward movement of the shelf 330 which tends to hold the shelf 330 in place. FIG. 27 is a front view of storage assembly 270 of FIG. 23. FIG. 27A is an enlarged view showing a ball track detail portion of FIG. 27 with ball 290 in cavity of bail cradle 280 and related parts.

FIG. 28 is another view of the assembly 270 of FIG. 27 showing a 24 pack 430 of beverage cans stored.

FIG. 29 is another view of the assembly 270 of FIG. 27 showing two 12 packs 440 of beverage cans stored.

FIG. 30 is another view of the assembly 270 FIG. 23 showing wine bottles 100 being stored. The ribs 350 on the top surface of the accessory shelf 330 are designed and intended to keep the bottles 100 in place. A tool 450, such as but not limited to a wine screw, corkscrew, can opener, or bottle opener, can be stored in a compartment 360.

FIG. 31 is another view of the assembly 270 FIG. 23 showing 12 beverage cans 460 being stored on the shelf 330 with the ribs 350 allowing for the cans 460 to be separated from one another.

FIG. 32 is another view of the assembly 270 FIG. 23 showing beer bottles 470 being stored on the shelf 330 with the ribs helping separate and retain the bottles 470.

FIG. 23 is a side view of the assembly 270 of FIG. 23 with the bail cradles 280 folded down. FIG. 34 is another side view of the assembly 270 of FIGS. 23 and 33 with the bail cradles 280 folded up in the direction of arrow F.

FIG. 35 is an exploded view of the assembly 270 of FIG. 23.

FIG. 36 is a front view of the assembly 270 of FIG. 23. FIG. 37 is a rear view of the assembly 270 of FIG. 23. FIG. 38 is a right side view of the assembly 270 of FIG. 23. FIG. 39 is a left side view of the assembly 270 of FIG. 23. FIG. 40 is a top view of the assembly 270 of FIG. 23. FIG. 41 is a bottom view of the assembly 270 of FIG. 23.

FIG. 42 is another view of the assembly FIG. 23 showing alternative rollers 475 replacing the previously shown rolling balls 290 on the bottom member of the bail cradles 472. FIG. 42A is an enlarged view of a corner the rollers 475 of FIG. 42.

FIG. 43 is another front view of the assembly 270 of FIG. 42 with accessory shelf 330 on the bail cradles 472. FIG. 43A is an enlarged view of a front corner section of FIG. 43.

Referring to FIGS. 42-43A, the rollers 475 can function similar to the previous embodiment using the balls 290.

FIG. 44 is another view of the assembly 270 of FIG. 23 with raised ribs 490 on the bail cradles 480. FIG. 44A is an enlarged view of a raised ribs 490 portion of FIG. 44. FIG. 45 is a front view of the assembly 270 of FIG. 44 with accessory shelf 330. FIG. 45A is an enlarged view of a corner section of FIG. 45. Referring to FIGS. 44-45A, the raised ribs 490 allow for easier loading on and off of the accessory shelf 330.

Third Embodiment

FIG. 46 is a top perspective view of a third embodiment of a fold-down storage assembly 500 with slide out tray/shelf 510. FIG. 47 is another view of the assembly 500 of FIG. 46 with the tray/shelf 510 shown down and fully retracted. FIG. 48 is a view of the assembly 500 of FIG. 47 with the tray/shelf 510 folded up. FIG. 49 is a side view of the assembly 500 of FIG. 47. FIG. 50 is another side view of the assembly 500 of FIG. 48 with the tray folded up. FIG. 51 is a top perspective view of the assembly 500 of FIG. 47 with the accessory tray/shelf 330 shown on the tray/shelf 510 and beverage cans 460 being stored. FIG. 52 is an exploded view of the assembly of FIG. 46. FIG. 53 is a front view of the assembly 500 of FIG. 47. FIG. 54 is a rear view of the assembly 500 of FIG. 47. FIG. 55 is a left side view of the assembly 500 of FIG. 47. FIG. 56 is a right side view of the assembly 500 of FIG. 47. FIG. 57 is a top view of the assembly 500 of FIG. 47. FIG. 58 is a bottom view of the assembly 500 of FIG. 47.

Referring to FIGS. 46 to 58, this embodiment has a tray/shelf 510 that is attached to swing down legs by a drawer slide assembly 530. The drawer slide assembly 530 lets the tray/shelf 510 slide forward and backward while maintaining a firm attachment to the storage assembly 500. The tray/shelf 510 is shown down and fully extended in this figure. The fold-down assembly 500 functions similar to the previous fold-down assemblies with left hand bracket 320, right hand bracket 325 and swing-down legs 520 that have upper ends pivotally attached to the brackets 320, 325 and lower ends pivotally attached to outer races 540 of drawer slide assembly 530 by fasteners 570, such as screws and the like. Each drawer slide assembly 530 can include an inner race 550 that slides into and out from the outer race 540. Additional fasteners 580, such as but not limited to screws, and the like can attach the inner race 550 of each drawer slide assembly 530 to sides of the tray/shelf 510 with nuts 590. Similar to the previous embodiments, bottles, cans, and the like can be stored on the shelf/tray 510 and tray 510.

A portable drawer/organizer with front wall (that can have a drawer pull handle), closed side walls, and backwall and open top can be incorporated with the slide out shelf/tray 510.

The invention can be used with slide out trays/shelves that support computer keyboards, and other computer accessories and the like. The novel assemblies can be used with attaching underneath tables, underneath desks, conference tables, under chairs, and under any other type of horizontal surface.

While the invention has been shown and described as being attachable and likewise detachable from refrigerator shelves, cabinets, other shelves and the like, the invention can be pre-attached to refrigerator shelves, and on cabinets, and other shelves, and the like.

Although the embodiments refer to using a flexible finger/tab with detents to lock the folded up or folded down position of the cradles, other techniques can be used such as but not limited to magnets, snaps, hook and loop fasteners, removable through pins and friction fit parts, and the like While the invention has been described, disclosed, illustrated and shown in various terms of certain embodiments or modifications which it has presumed in practice, the scope of the invention is not intended to be, nor should it be deemed to be, limited thereby and such other modifications or embodiments as may be suggested by the teachings herein are particularly reserved especially as they fall within the breadth and scope of the claims here appended.

I claim:

1. A foldable rack system, comprising:

a first elongated bracket having a front end and a rear end;

a second elongated bracket having a front end and a rear end, the first elongated bracket being spaced from and in parallel to the second elongated bracket;

a first cradle member having a left end and a right end, the left end of the first cradle member being pivotally attached to the first elongated bracket adjacent to the front end of the first elongated bracket, and the right end of the first cradle member being pivotally attached to the second elongated bracket adjacent to the front end of the second elongated bracket;

a second cradle member having a left end and a right end, the left end of the second cradle member being pivotally attached to the first elongated bracket adjacent to the rear end of the first elongated bracket, and the right end of the second cradle member pivotally attached to the second elongated bracket adjacent to the rear end of the second elongated bracket, the second cradle member being spaced apart and parallel to the first cradle member, wherein the first cradle member and the second cradle member are pivotally moveable from a folded down position with the first and the second cradle members extending downward from the first and the second elongated brackets, to a folded up position with the first and the second cradle members both folded adjacent to the first and the second elongated brackets;

an accessory shelf for sliding on the first and the second cradle members when the first and the second cradle members are in the folded down position; and rotatable balls on upper surfaces of the first and the second cradle members for allowing the accessory shelf to easily slide thereon.

2. The foldable rack system of claim 1, further comprising:

a pair of straps for attaching each of the first and the second elongated brackets under a shelf.

3. The foldable rack system of claim 1, further comprising:

a left link arm having a rear end and a front end, the rear end being pivotally attached to the left end of the second cradle member, the front end of the left link arm being pivotally attached to the left end of the first cradle member; and a right link arm having a rear end and a front end, the rear end of the right link arm being pivotally attached to the right end of the second cradle member, the front end of the right link arm being pivotally attached to the right end of the first cradle member.

4. The foldable rack system of claim 1, further comprising:

bendable tabs and detents for locking the first and the second cradle members in the folded up position and the folded down position.

5. The foldable rack system of claim 1, further comprising:

screw fasteners for attaching each of the first and the second elongated brackets to an under surface of a shelf.

6. The foldable rack system of claim 1, wherein the accessory shelf includes:

a plurality of raised ribs spaced apart from one another on at least one side of the accessory shelf.

7. The foldable rack system of claim 1, further comprising:

anti-tip tabs on inner sides of the first and the second cradle members for keeping the accessory shelf from tilting.

8. The foldable rack system of claim 1, further comprising:

a third cradle member having a left end and a right end, the left end of the third cradle member being pivotally attached to the first elongated bracket between the front end and the rear end of the first elongated bracket, and the right end of the third cradle member pivotally attached to the second elongated bracket between the front end and the rear end of the second elongated bracket, the third cradle member being spaced apart and parallel to the first cradle member and the second cradle member.

9. The foldable rack system of claim 8, further comprising:

a left link arm having a rear end and a front end, the rear end being pivotally attached to the left end of the second cradle member, the front end of the left link arm being pivotally attached to the left end of the first cradle member, and a middle portion of the left link arm being pivotally attached to the left end of the third cradle member; and a right link arm having a rear end and a front end, the rear end of the right link arm being pivotally attached to the right end of the second cradle member, the front end of the right link arm being pivotally attached to the right end of the first cradle member, and a middle portion of the right link arm being pivotally attached to the right end of the third cradle member.

10. A foldable rack system, comprising:

a first elongated bracket having a front end and a rear end;

a second elongated bracket having a front end and a rear end, the first elongated bracket being spaced from and in parallel to the second elongated bracket;

a first foldable cradle member having a left end and a right end, the left end of the first foldable cradle member being foldable to the first elongated bracket, and the right end of the first foldable cradle member being foldable to the second elongated bracket;

a second foldable cradle member having a left end and a right end, the left end of the second foldable cradle member being foldable to the first elongated bracket, and the right end of the second foldable cradle member being foldable to the second elongated bracket;

an accessory shelf for sliding on the first and the second cradle members when the first and the second cradle members are in a folded down position; and rotatable balls on upper surfaces of the first and the second cradle members for allowing the accessory shelf to easily slide thereon.

11. The foldable rack system of claim 10, further comprising:

a third foldable cradle member having a left end and a right end, the left end of the third foldable cradle member being foldable to the first elongated bracket, and the right end of the third foldable cradle member being foldable to the second elongated bracket; and rotatable balls on upper surfaces of the third foldable cradle member for allowing the accessory shelf to easily slide thereon.

12. The foldable rack system of claim 10, further comprising:

a pair of straps for attaching each of the first and the second elongated brackets under a shelf.

13. The foldable rack system of claim 10, further comprising:

screw fasteners for attaching each of the first and the second elongated brackets to an under surface of a shelf.

14. The foldable rack system of claim 10, wherein the accessory shelf includes:

a plurality of raised ribs spaced apart from one another on at least one side of the accessory shelf.

15. The foldable rack system of claim 10, further comprising:

anti-tip tabs on inner sides of the first and the second foldable cradle members for keeping the accessory shelf from tilting.

* * * * *